US010843359B2

(12) United States Patent
Ruhland et al.

(10) Patent No.: US 10,843,359 B2
(45) Date of Patent: Nov. 24, 2020

(54) CONNECTING CUT ASSEMBLY

(71) Applicant: BHS Corrugated Maschinen- und Anlagenbau GmbH, Weiherhammer (DE)

(72) Inventors: Karl Ruhland, Pfreimd (DE); Norbert Städele, Parkstein (DE); Bernhard Jentsch, Mantel (DE)

(73) Assignee: BHS Corrugated Maschinen- und Anlagenbau GmbH, Weiherhammer (DE)

( * ) Notice: Subject to any disclaimer, the term of this patent is extended or adjusted under 35 U.S.C. 154(b) by 26 days.

(21) Appl. No.: 16/117,425

(22) Filed: Aug. 30, 2018

(65) Prior Publication Data

US 2019/0070742 A1 Mar. 7, 2019

(30) Foreign Application Priority Data

Sep. 6, 2017 (DE) ..... 10 2017 215 712

(51) Int. Cl.

| | |
|---|---|
| ***B26D 1/62*** | (2006.01) |
| ***B26D 1/04*** | (2006.01) |
| ***B26D 1/18*** | (2006.01) |
| ***B26D 1/60*** | (2006.01) |
| ***B26D 7/26*** | (2006.01) |

(52) U.S. Cl.

CPC ..... *B26D 1/626* (2013.01); *B26D 1/045* (2013.01); *B26D 1/185* (2013.01); *B26D 1/605* (2013.01); *B26D 7/2635* (2013.01); *B26D 2210/11* (2013.01)

(58) Field of Classification Search

CPC ..... B26D 1/626; B26D 1/045; B26D 1/185; B26D 1/605; B26D 7/2635; B26D 2210/11

See application file for complete search history.

(56) References Cited

U.S. PATENT DOCUMENTS

| | | | | |
|---|---|---|---|---|
| 2006/0201306 | A1* | 9/2006 | Zannini | B26D 7/2635 83/698.11 |
| 2008/0115641 | A1 | 5/2008 | Freyburger et al. | |
| 2013/0305894 | A1* | 11/2013 | Nobukuni | B26D 1/605 83/37 |
| 2014/0121085 | A1* | 5/2014 | Kwarta | B26D 7/2628 483/10 |

(Continued)

FOREIGN PATENT DOCUMENTS

| | | |
|---|---|---|
| DE | 14 54 971 B1 | 9/1970 |
| DE | 693 13 491 T2 | 1/1998 |

(Continued)

*Primary Examiner* — Omar Flores Sanchez
(74) *Attorney, Agent, or Firm* — McGlew and Tuttle, P.C.

(57) ABSTRACT

The invention relates to a connecting cut assembly for producing connecting cuts in a material web being conveyed. The connecting cut assembly comprises at least one knife device with a cutting knife for cutting engagement with the material web to produce a connecting cut in the material web. Moreover, the at least one knife device has an actuatable cutting knife angle adjusting device for setting a respective cutting knife angle of the cutting knife to the material web. The connecting cut assembly comprises at least one presetting unit for actuating the respective cutting knife angle adjusting device.

21 Claims, 18 Drawing Sheets

(56) References Cited

U.S. PATENT DOCUMENTS

| | | | | |
|---|---|---|---|---|
| 2015/0174781 | A1* | 6/2015 | Baba | B26D 1/185<br>83/453 |
| 2017/0028579 | A1* | 2/2017 | Drebes | B26D 1/205 |
| 2018/0141228 | A1* | 5/2018 | Lin | B26D 1/185 |
| 2018/0304486 | A1* | 10/2018 | Nakatsu | B26D 5/06 |
| 2018/0370059 | A1* | 12/2018 | Hsu | B26D 7/2635 |
| 2019/0061191 | A1* | 2/2019 | Sanz Ananos | B26D 1/245 |

FOREIGN PATENT DOCUMENTS

| | | | |
|---|---|---|---|
| DE | 696 00 387 | T2 | 11/1998 |
| DE | 60 2004 000 711 | T2 | 5/2007 |
| DE | 10 2008 035 278 | A1 | 2/2010 |
| EP | 0 607 084 | B1 | 4/1997 |
| EP | 0 562 454 | B1 | 9/1997 |
| EP | 0 795 382 | A2 | 9/1997 |
| EP | 0 737 553 | B1 | 7/1998 |
| EP | 1 452 283 | A1 | 9/2004 |
| EP | 1 452 283 | B1 | 4/2006 |
| FR | 2 529 817 | A1 | 1/1984 |
| JP | S54-53381 | A | 4/1979 |
| JP | H06-210772 | A | 8/1994 |
| JP | H07-186309 | A | 7/1995 |
| JP | H09-248788 | A | 9/1997 |
| JP | H09-300492 | A | 11/1997 |
| JP | H10-86 093 | A | 4/1998 |
| JP | H10-86 245 | A | 4/1998 |
| JP | 2002-36 171 | A | 2/2002 |
| JP | 2004-276231 | A | 10/2004 |

* cited by examiner

CONNECTING CUT ASSEMBLY

CROSS-REFERENCE TO RELATED APPLICATIONS

This application claims priority of German Patent Application Serial No. DE 10 2017 215 712.7, filed on Sep. 6, 2017, pursuant to 35 U.S.C. 119(a)-(d), the content of which is incorporated herein by reference in its entirety as if fully set forth herein.

FIELD OF THE INVENTION

The invention relates to a connecting cut assembly for producing connecting cuts in a material web being conveyed in a conveying direction, especially in a corrugated cardboard web, which is preferably at least three-ply and advantageously laminated on both sides.

BACKGROUND OF THE INVENTION

Job change cutting devices are known in the prior art, producing a connecting cut between two laterally spaced apart longitudinal cuts in a material web in the event of a job change. In general, the partial corrugated cardboard webs arising from the longitudinal cuts are taken in different levels into a transverse cutting device for the production of corrugated cardboard sheets. Problems occasionally occur during operation in such job change cutting devices, which might require a stoppage of the material web or of the overall plant.

SUMMARY OF THE INVENTION

The problem which the invention proposes to solve is to provide a connecting cut assembly with especially secure functioning, in particular even at extremely high conveying speeds of the material web. Furthermore, a corresponding corrugated cardboard plant should be created.

This problem is solved according to the invention by a connecting cut assembly for producing connecting cuts in a material web being conveyed in a conveying direction, especially in a corrugated cardboard web, with at least one knife device, comprising a cutting knife for cutting engagement with the material web to produce a connecting cut, wherein the cutting knife is adjustable in its angle to the material web, especially to its conveying direction or transverse direction.

Furthermore, this problem is solved according to the invention by a corrugated cardboard plant for production of corrugated cardboard, comprising an assembly for producing a material web, especially an at least three-ply corrugated cardboard web, a job change cutting device situated downstream of the assembly for producing a material web for producing a first longitudinal cut in a first transverse position of the material web corresponding to a first job and a second longitudinal cut in a second transverse position of the material web, different from the first transverse position, and corresponding to a second job, and a connecting cut assembly situated upstream from the job change cutting device according to the invention for producing a connecting cut in the material web being delivered in the conveying direction.

The crux of the invention lies in the fact that the cutting knife is adjustable in its angle to the material web or to its conveying direction or transverse direction in order to produce a correspondingly oriented connecting cut to the material web or to its conveying direction or transverse direction. The cutting knife for example can be oriented in its angle such that the connecting cut produced in the material web extends diagonally to the conveying direction of the material web. The connecting cut for example has a predetermined length and/or a predetermined spacing from at least one lengthwise edge of the material web. A complete severing of the material web along its entire width is also preferably possible by means of the cutting knife. The cutting knife is also advantageously settable in its angle so that the resulting connecting cut in the material web extends perpendicular to the conveying direction of the material web. According to one preferred embodiment, in particular, this is only possible when the corrugated cardboard plant is at standstill or the material web is motionless.

It is advantageous to set the cutting knife at a corresponding angle to the material web, at least temporarily. For this, the cutting knife is advantageously mounted appropriately. Advantageously, the cutting knife is suspended or mounted in a pendulum.

It is advisable for the cutting knife of the at least one knife device to be designed as a circular knife. The circular knife preferably has a relatively small diameter. It is advantageous for the diameter to be between 100 mm and 180 mm. Preferably, a right angle is present between the cutting knife and a neighbouring surface of the material web.

The connecting cut assembly is preferably active during a job change. By a job change is meant here in particular a changed cutting pattern or longitudinal cut of the material web. A format change preferably occurs during the job change. The material web or partial webs produced from it may have a different width after the format change. Prior to the job change, in particular, a first job is worked off, while after the job change a second job is worked off. The partial webs are preferably taken to individual transverse cutting units of a transverse cutting device to produce corrugated cardboard sheets from the partial webs.

It is advantageous for the connecting cut assembly to comprise between one and four knife devices. If more than one knife device is present, they are preferably adjustable independently of each other.

It is advisable for the connecting cut assembly to be able to produce by means of the connecting cut a seamless connection between a first or earlier longitudinal cut and a second or later longitudinal cut. Alternatively, the connecting cut assembly is able, for example, to produce by means of the connecting cut a connection between a longitudinal cut and a longitudinal edge of the material web. Preferably, endless (partial) webs or cutouts from the material web can be produced by the connecting cut assembly. It is advantageous for the connecting cut to run straight in the material web. The webs separated from each other by the respective longitudinal cut can be taken to transverse cutting units of a transverse cutting device, as mentioned.

The assembly for producing a material web advantageously comprises at least one corrugated cardboard production device for producing a corrugated cardboard web laminated on one side, having a corrugated web and a cover web.

Preferably, the assembly for producing a material web comprises a connecting device for connecting the at least one corrugated cardboard web, laminated on one side and preferably glued, to a laminating web.

It is advantageous for the material web to be endless. The material web in particular is three-ply, five-ply or seven-ply.

The terms used here "arranged in front", "arranged behind", "upstream", "downstream", "in succession", or the like pertain preferably to the conveying direction of the conveyed material web.

Other advantageous embodiments of the invention are indicated in the dependent claims.

The cutting knife angle adjusting device for setting a respective cutting knife angle of the cutting knife to the material web preferably has an actuatable unit, such as a motor or drive, which is preferably pneumatic, hydraulic and/or electrical in operation.

The cutting knife angle adjusting of the at least one knife device, which comprises an adjustable stop element assembly and a counter element, which is in a firm angular connection with the cutting knife of the at least one knife device and interacts with the stop element assembly to set the respective cutting knife angle, is on the one hand extremely secure in its functioning. On the other hand, it has a very simple construction. Alternatively, the cutting knife angle adjusting device comprises, for example, a step motor for the angular adjustment of the cutting knife.

The at least one presetting unit for actuating the respective cutting knife angle adjusting device is preferably electrical, especially electronic. Preferably, it is able to actuate or in particular activate the respective cutting knife angle adjusting device accordingly. Alternatively, the at least one presetting unit is designed as a regulating unit.

It is expedient for the at least one presetting unit to stand in a signal connection with the cutting knife angle adjusting device of the at least one knife device for the transmitting of corresponding signals.

It is advantageous for the cutting knife angle of the cutting knife engaging with the material web to be set automatically by the conveyed material web or its conveying speed.

Alternatively or additionally, the at least one presetting unit preferably in particular automatically actuates the cutting knife angle adjusting device, if appropriate. Preferably, a speed detecting assembly detects the respective conveying speed of the material web, especially near the connecting cut assembly. The conveying speed may be detected directly or indirectly. It may be detected by contact or without contact. Advisedly, the conveying speed of the material web is constant while working off a particular job.

Preferred cutting knife angles are such that at a first conveying speed of the material web a first cutting knife angle to the conveying direction is present and at a second conveying speed of the material we, different from the first conveying speed, a second cutting knife angle to the conveying direction is present, differing from the first cutting knife angle. A first cutting knife transverse angle to a connection line running perpendicular to the conveying direction of the material web at relatively high conveying speed of the material web is larger than a corresponding second cutting knife transverse angle to the connection line which is present at a slower conveying speed of the material web. In one embodiment, the at least one knife device comprises a brake assembly for at least temporary holding the cutting knife angle.

It is advisable for the first cutting knife transverse angle as set out above to be between 130° and 160°, at the relatively high conveying speed from 5 m/s to 9 m/s.

It is advisable for the second cutting knife transverse angle to be between 95° and 125°, at the slower conveying speed from 0.5 m/s to 5 m/s.

The brake assembly for at least temporary holding the cutting knife angle is advisedly inactive at least during the cutting process, in order to allow a free swinging of the cutting knife in order to set the cutting knife angle. It is advantageous for the brake assembly to have at least one brake element, which then engages directly or indirectly with the cutting knife, by braking or rubbing.

The positioning detection assembly of the at least one knife device for detecting a respective cutting knife angle has preferably a noncontact operation. It is advisedly designed as a sensor assembly, camera assembly, or the like. The positioning detection assembly detects a position of a cutting knife transverse displacement assembly in relation to the material web in order to regulate exactly the cutting knife transverse displacement assembly. Thus, in operation, a particular actual angle present for the corresponding cutting knife relative to the material web can be set exactly. Advisedly, the positioning detection assembly stands in signal connection with the presetting unit.

The embodiment configured such that the at least one presetting unit comprises at least one correction unit for correcting a deviation between the detected cutting knife angles and a target cutting knife angle enables particularly exact connecting cuts.

The rotary drive of the at least one knife device for rotational driving of the cutting knife is preferably designed as a pneumatic drive. It preferably is in signal connection with the presetting unit. Alternatively, for example, it is a hydraulic drive or electric drive.

The cutting knife displacement assembly for displacing the cutting knife between an active cutting position for cutting engagement with the material web and an inactive position, wherein preferably an adjustment of the cutting knife angle occurs in the inactive position of the cutting knife, is advisedly able to change the spacing between the cutting knife and the material web being cut or a depth of insertion of the cutting knife into the material web. Preferably, a displacement of the cutting knife occurs in a vertical direction. It is advantageous for the cutting knife displacement assembly to stand in signal connection with the presetting unit.

Advisedly, for displacing the cutting knife in a transverse direction of the material web, a displacement speed of the cutting knife between the active cutting position and the inactive position is independent of a conveying speed of the material web.

The cutting knife transverse displacement assembly preferably comprises at least one cross beam extending diagonally with respect to the conveying direction of the material web to carry the at least one knife device. Preferably, the cutting knife transverse displacement assembly comprises at least one transverse displacement drive for the displacement of the at least one knife device along the cross beam.

The at least one cross beam of the cutting knife transverse displacement assembly, which is swivelable about a vertical pivot axis, is preferably able to subtend with the material web a diagonal position angle which can be up to ±45°. Connecting cuts in the material web can thus be produced especially easily and exactly. In particular, the cutting scraps are minimal, since the connecting cut runs only along an especially short lengthwise region of the material web or perpendicular to it.

Advisedly, a displacement speed of the cutting knife in the transverse direction of the material web is dependent on a conveying speed of the material web, with a relatively high displacement speed of the cutting knife in the transverse direction of the material web being present at a relatively high conveying speed of the material web. As compared to a slowly conveyed material web, the displacement speed of the cutting knife in the transverse direction of the material web is higher for a fast conveyed material web.

A preferred embodiment of the invention shall be described by way of example below with reference to the accompanying drawing.

DESCRIPTION OF THE PREFERRED EMBODIMENT

Figure 17:
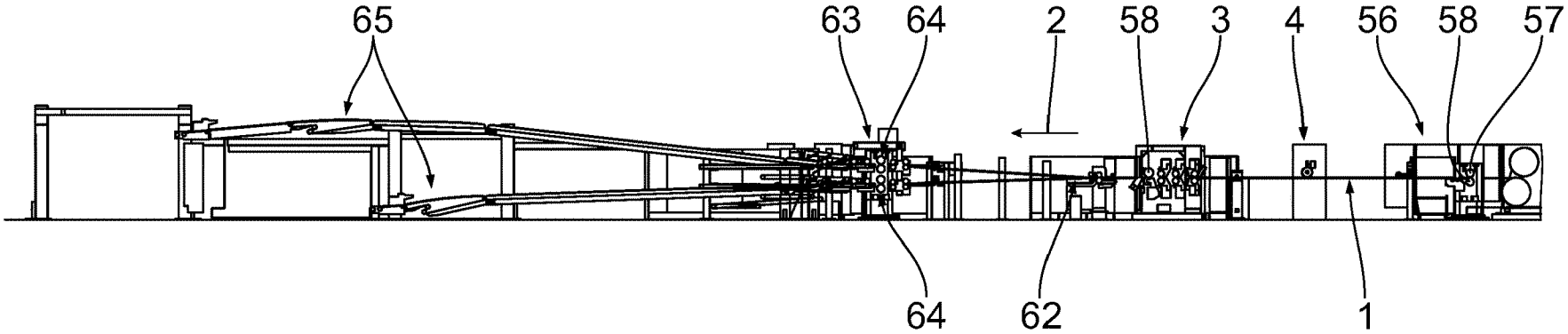

First of all referring to FIG. 17, a corrugated cardboard plant, not represented in its entirety, for making corrugated cardboard sheets from a two-sided laminated corrugated cardboard web 1 comprises at least one corrugated cardboard production device for making a respective one-sided laminated corrugated cardboard web.

The at least one corrugated cardboard web production device comprises at least one corrugation assembly for producing a respective corrugated web from a material web, especially an endless material web. Moreover, the at least one corrugated cardboard production device has at least one glue application assembly for applying glue to the tips of the respective corrugated web. This comprises, moreover, at least one pressing assembly for pressing a respective smooth, especially an endless material web against the corresponding glued corrugated web to form the one-sided laminated corrugated cardboard web.

Downstream from the at least one corrugated cardboard production device the corrugated cardboard plant has a gluing unit, which applies glue to the respective corrugated web of the at least one one-sided laminated corrugated cardboard web.

Downstream from the gluing unit, the corrugated cardboard plant comprises a heating and pressing device, comprising a heating bench and a pressing assembly located above it. The at least one one-sided laminated corrugated cardboard web and a laminating web, especially an endless one, are led through a pressing gap, bounded by the pressing assembly and the heating bench, where the at least one one-sided laminated corrugated cardboard web and the laminating web are pressed together and glued to each other.

Figure 1:
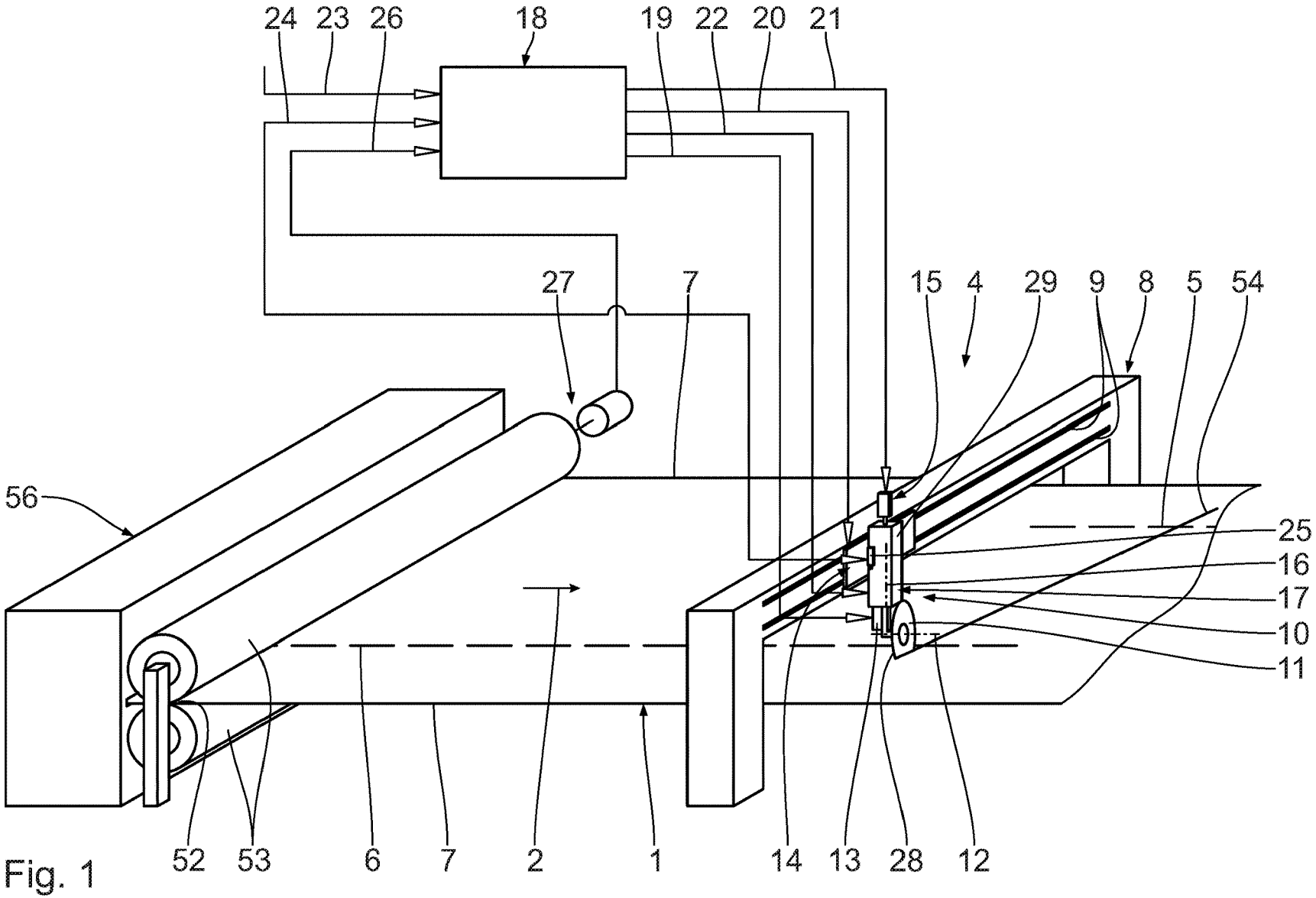
FIG. 1 a simplified view of a connecting cut assembly according to the invention and a short transverse cutting device arranged in front of it, FIG. 2 a side view of the connecting cut assembly of FIG. 1 illustrating details, FIG. 3 a perspective view showing in particular the knife device of the connecting cut assembly shown in FIG. 2, FIG. 4 a side view of the knife device shown in FIG. 3, in an inactive upper position, FIG. 5 a view corresponding to FIG. 4, where the knife device there is in an active lower cutting position, FIGS. 6 to 8 top views of the knife devices shown in FIGS. 3 to 5, where their cutting knives are at different cutting knife angles, FIG. 9 a simplified top view of a short transverse cutting device and a connecting cut assembly per FIG. 1 placed behind it, having produced a first diagonal connecting cut, FIG. 10 side views showing the knife device of FIG. 9 in an active cutting position and an inactive position, FIG. 11 a top view corresponding to FIG. 9, where the knife device has produced a second diagonal connecting cut, differing in its angle from the first connecting cut, FIGS. 12 to 16 different views of the connecting cut assembly shown in FIG. 1, illustrating different positions of the knife device for producing a connecting cut, and FIG. 17 a partial side view of a corrugated cardboard plant according to the invention, illustrating the position of the connecting cut assembly per FIGS. 1 to 16, FIGS. 18 to 21 top views of material webs showing further possible connecting cuts, FIG. 22 a top view of an alternative connecting cut assembly according to the invention, and FIG. 23 a side view of the connecting cut assembly represented in FIG. 22.
Figure 2:
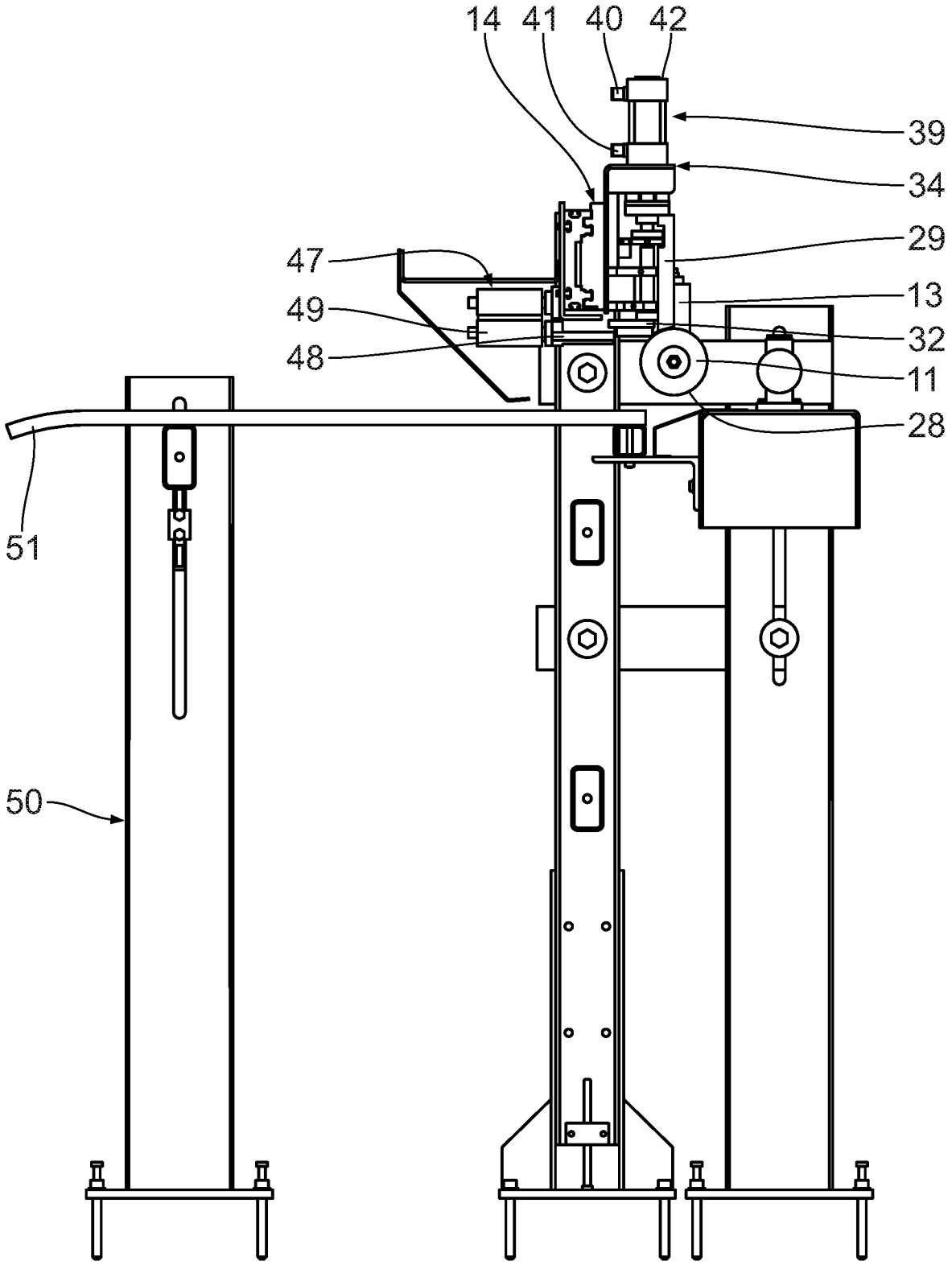
Figure 3:
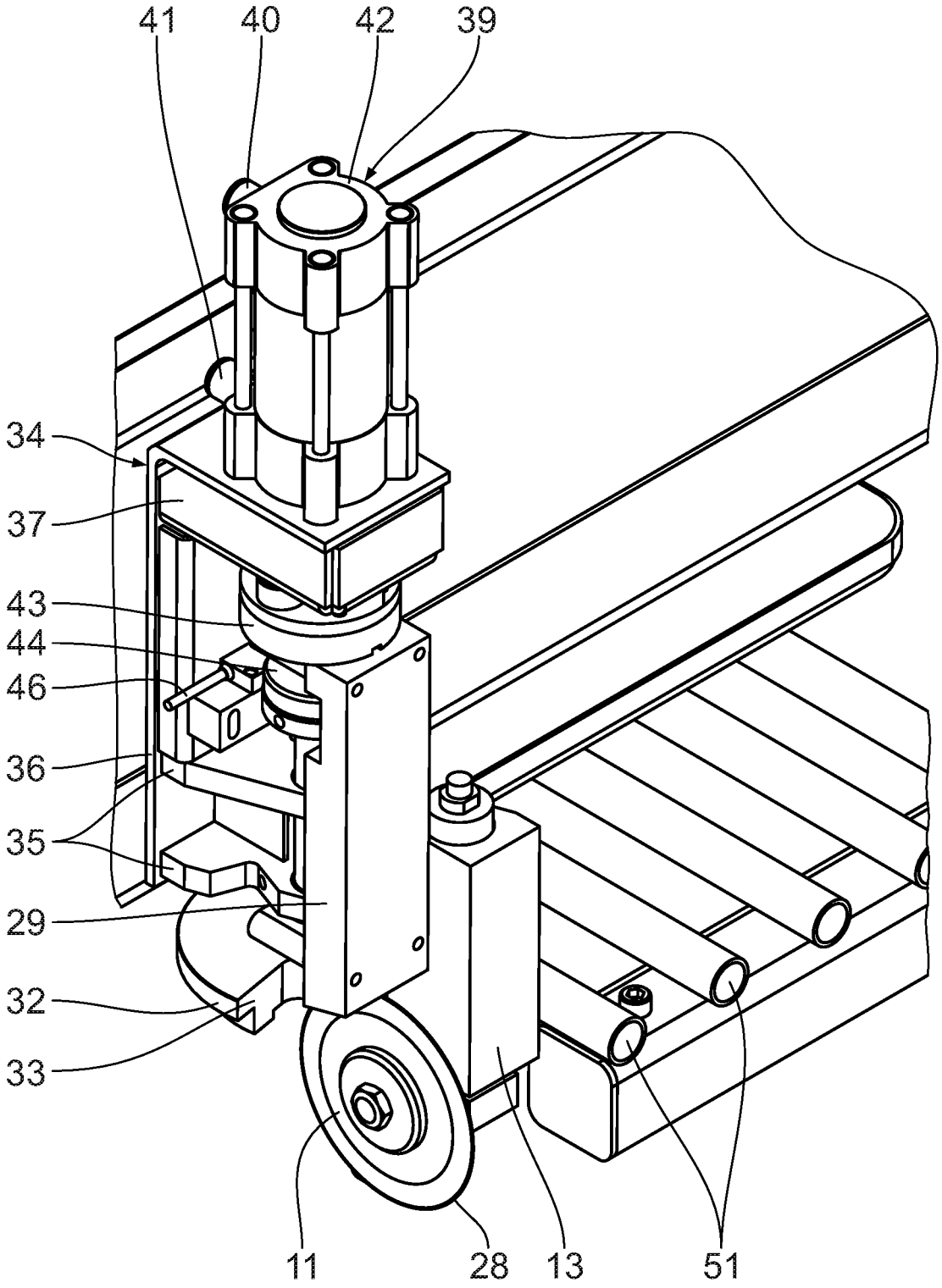
Figure 5:
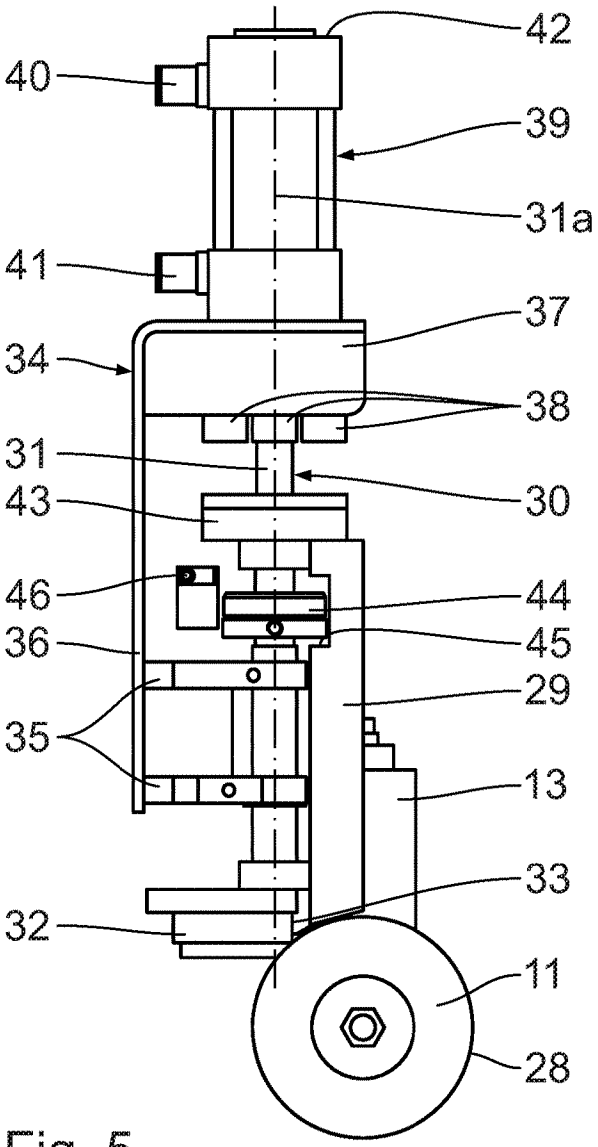
Figure 4:
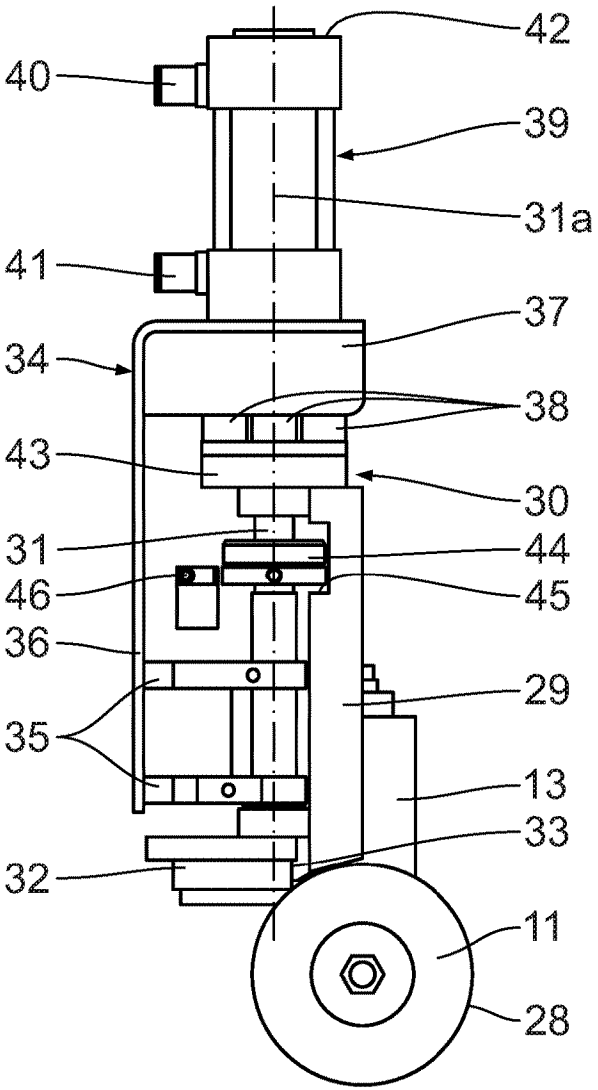
Figure 6:
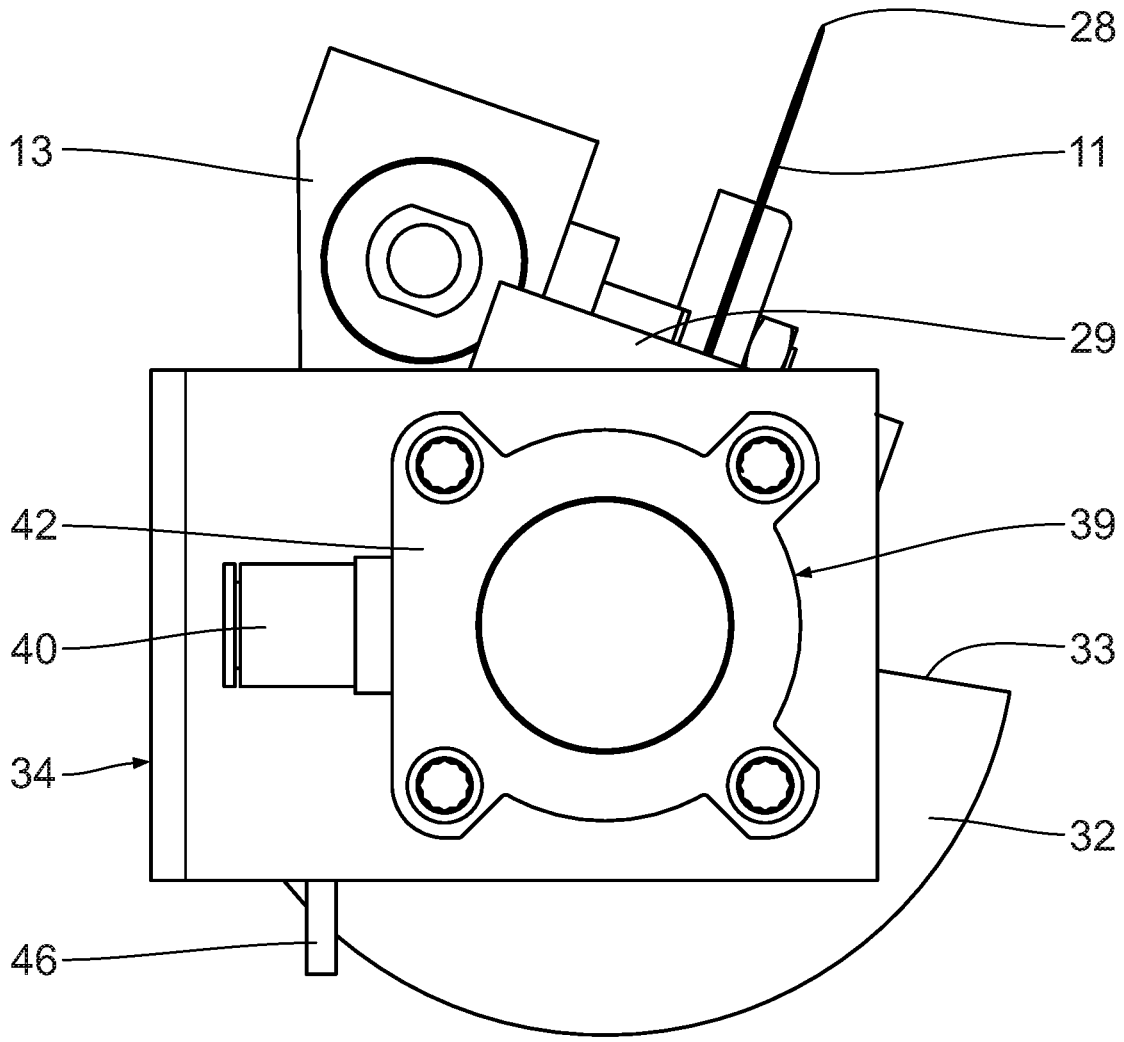
Figure 7:
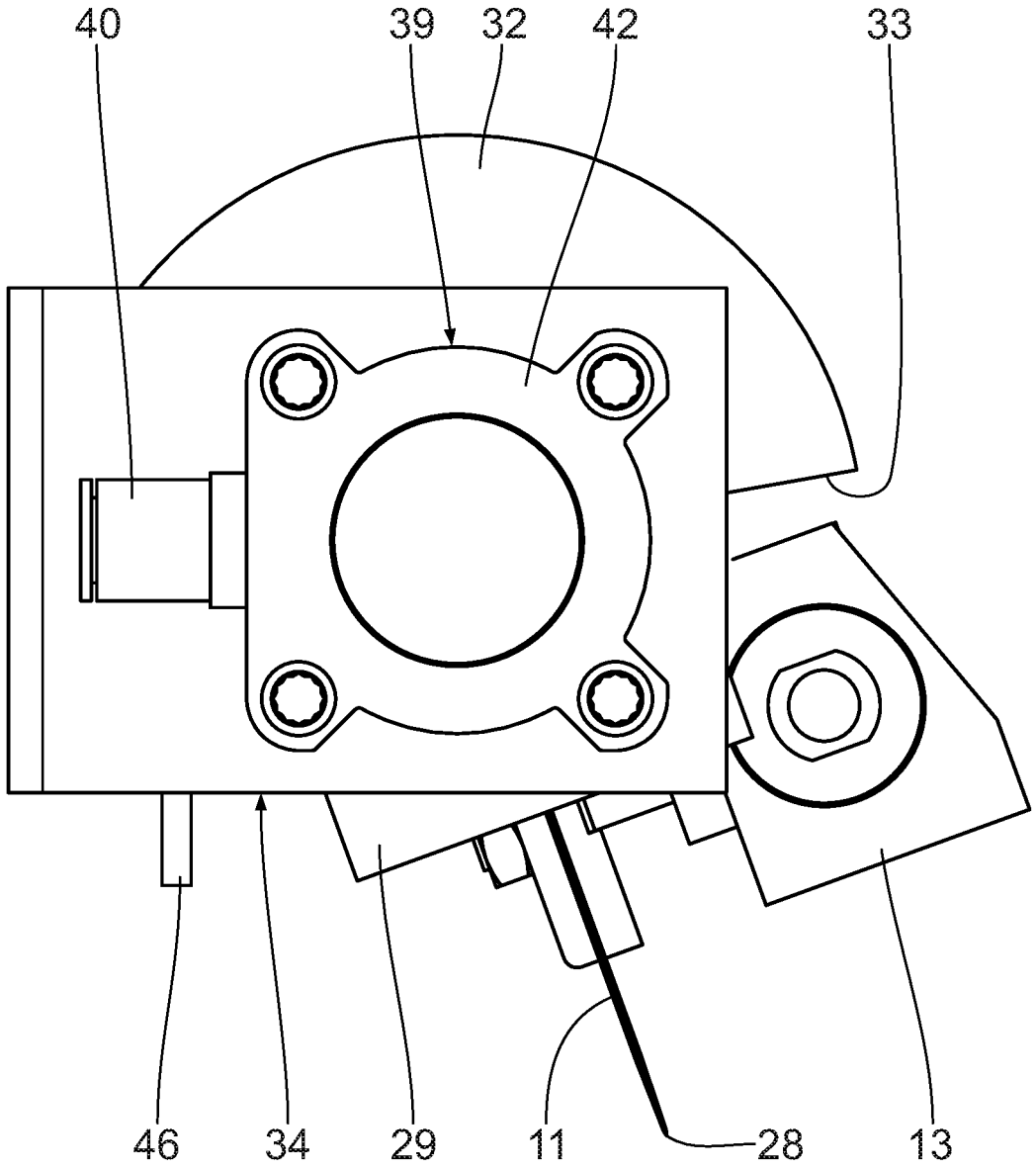
Figure 8:
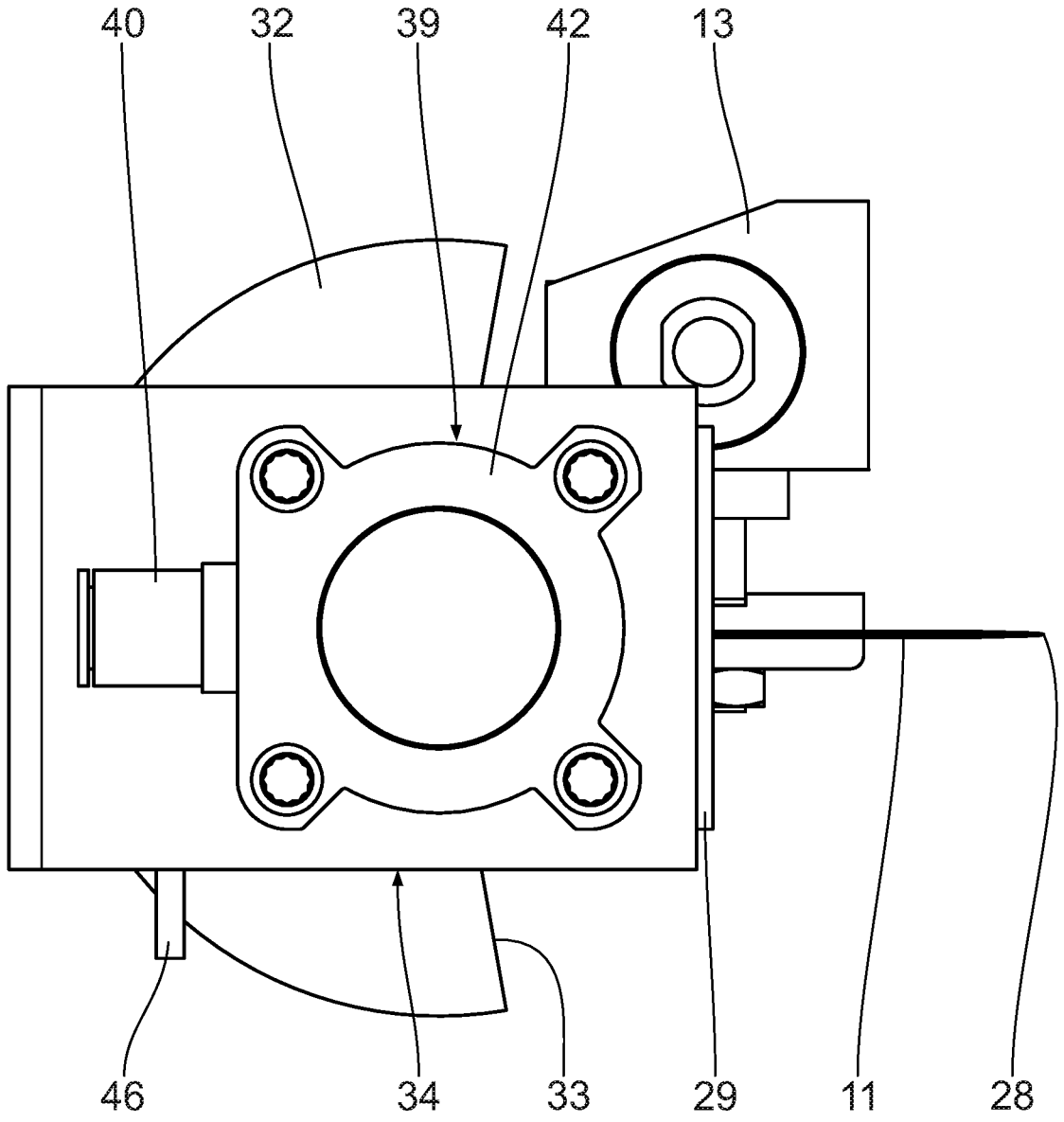

In the heating and pressing device, the two-sided laminated, at least three-ply corrugated cardboard web 1 is formed, being endless and represented in FIG. 1. The two-sided laminated corrugated cardboard web 1 is delivered continuously in a conveying direction 2.

The heating and pressing device is followed in the conveying direction 2 by a short transverse cutting device 56, comprising a knife cylinder 57 and a counter cylinder 58 arranged beneath it. The knife cylinder 57 and the counter cylinder 58 are rotary mounted, their axes of rotation running parallel to each other and perpendicular to the conveying direction 2 of the two-sided laminated corrugated cardboard web 1. The knife cylinder 57 and/or the counter cylinder 58 is/are in driving connection with at least one drive motor.

The knife cylinder 57 has a cylinder shell, on which a cutting knife with a cutting edge is secured. The counter cylinder 58 also has a cylinder shell, on which a counter knife with a cutting edge is secured. Moreover, a series of counter elements are arranged on the cylinder shell of the counter cylinder 58, which can be displaced between two radially protruding stops, fastened to the cylinder shell and extending across a width of the counter cylinder 58.

The short transverse cutting device 56 is able to produce a cut extending across the full width of the two-sided laminated corrugated cardboard web 1. For this, the knife cylinder 57 and the counter cylinder 58 are placed in rotation so that they interact with each other in cutting fashion during the cutting process. Moreover, the short transverse cutting device 56 is able to produce a cut with a given length and a given spacing from a lengthwise edge of the two-sided laminated corrugated cardboard web 1. For this, the counter elements are chosen and moved appropriately. For the cutting process, the knife cylinder 57 and the counter cylinder 58 are placed in rotation such that the knife of the knife cylinder 57 interacts with the counter elements.

The short transverse cutting device 56 also serves on the one hand for the secure removal of starting scraps and on the other hand for carrying out job or format changes. With the short transverse cutting device 56, connecting cuts can be produced during a format change perpendicular or diagonally to the conveying direction 2 of the two-sided laminated corrugated cardboard web 1.

After the short transverse cutting device 56 in the conveying direction 2 comes a job change cutting device 3 of the corrugated cardboard plant to carry out job changes, being designed as a lengthwise cutting/scoring device.

A connecting cut assembly 4 of the corrugated cardboard plant is situated downstream between the short transverse cutting device 56 and the job change cutting device 3.

The job change cutting device 3 comprises at least one lengthwise cutting station 58. The at least one lengthwise cutting station 58 comprises a knife, especially a rotary driven knife, which is displaceable perpendicular to the conveying direction 2 and can be brought to engage with the two-sided laminated corrugated cardboard web 1 to form at least one longitudinal cut in it.

Advisedly, the job change cutting device 3 has at least one brush roll on the other side of the two-sided laminated corrugated cardboard web 1, which interacts with the knife when the knife is in cutting engagement with the two-sided laminated corrugated cardboard web 1.

The job change cutting device 3 moreover comprises at least one scoring station with at least two tool beds, arranged in mirror symmetry to the two-sided laminated corrugated cardboard web 1. Creasing tools are provided on the tool beds arranged on tool carriers and individually displaceable transversely to the conveying direction 2 of the two-sided laminated corrugated cardboard web 1. Each time, two creasing tools are arranged in pairs on a tool carrier in the conveying direction 2.

The job change cutting unit 3 is capable of producing a first longitudinal cut in the two-sided laminated corrugated cardboard web 1, as indicated in FIG. 1. There, the first longitudinal cut has been given the reference number 5.

In order to change a cutting pattern of the two-sided laminated corrugated cardboard web 1, the job change cutting device 3 is able to produce a second longitudinal cut in the two-sided laminated corrugated cardboard web 1, which is given the reference number 6 in FIG. 1. The longitudinal cuts 5, 6 extend in the conveying direction 2 of the two-sided laminated corrugated cardboard web 1 and each have a constant spacing from a lengthwise edge 7 of the two-sided laminated corrugated cardboard web 1. The spacing of the longitudinal cuts 5, 6 from the lengthwise edges 7 is different, so that the final two-sided laminated corrugated cardboard webs 1 or partial corrugated cardboard webs produced from them have a different width perpendicular to the conveying direction 2. A spacing exists between the longitudinal cuts 5, 6 perpendicular to the conveying direction 2. The second longitudinal cut 6 follows the first longitudinal cut 5. The longitudinal cuts 5, 6 are substantially offset from each other in the conveying direction 2. Advisedly, however, the longitudinal cuts 5, 6 overlap for a portion in the conveying direction 2.

The connecting cut assembly 4 comprises a cross beam 8, which in this embodiment extends perpendicular to the conveying direction 2 across the two-sided laminated corrugated cardboard web 1 and is braced against a bottom or base preferably on both sides of the two-sided laminated corrugated cardboard web 1. On the cross beam 8 there is formed a guiding assembly 9, which extends along the cross beam 8 and thus perpendicular to the conveying direction 2.

The connecting cut assembly 4 furthermore comprises a knife device with a circular knife 11, having a circumferential or ring-shaped cutting edge 28, which can be rotationally driven about an axis of rotation 12, especially a horizontal one. The axis of rotation 12 coincides with a centre axis of the circular knife 11. The circular knife 11 stands in a driving connection with a rotary drive 13, which is designed as a pneumatic rotary drive. In particular, the circular knife 11 stands in a driving connection with a rotationally drivable drive shaft of the rotary drive 13. The drive connection between the rotary drive 13 and the circular knife 11 can be direct or indirect.

The knife device 10 as a whole is displaceable along the guiding assembly 9, i.e., in the transverse direction of the two-sided laminated corrugated cardboard web 1. For this, a transverse displacement assembly 14 is present with a transverse displacement drive.

The circular knife 11 is furthermore displaceable between an active lower cutting position for the cutting engagement with the corrugated cardboard web 1 (FIG. 1) and an inactive upper position outside of the corrugated cardboard web 1. A vertical displacement assembly 15 is used for this.

The circular knife 11 is furthermore able to swivel about a pivot axis 16, which runs perpendicular to the axis of rotation 12 and extends vertically here. For this, the knife device 10 has an angle adjusting device 17.

Moreover, the connecting cut assembly 4 has an electronic presetting unit 18, which stands in signal connection by a first signal line 19 with the rotary drive 13 for actuating the latter. The presetting unit 18 stands in signal connection with the transverse displacement drive by a second signal line 20 for its actuation. It stands in signal connection by a third signal line 21 with the vertical displacement assembly 15 for its actuation. The presetting unit 18 stands in signal connection by a fourth signal line 22 with the angle adjusting device 17 for its actuation.

Moreover, the presetting unit 18 stands in signal connection by a fifth signal line 23 with an executive electronic control system (not shown), in order to receive from the latter information or signals for new job orders, for example. The presetting unit 18 furthermore receives respective position signals of the circular knife 11 by a sixth signal line 24 from a positioning detection assembly 25. The presetting unit 18 stands in signal connection by a seventh signal line 26 with a web speed detection assembly 27 for detecting a respectively prevailing conveying speed of the two-sided laminated corrugated cardboard web 1 in the conveying direction 2. Alternatively, respective wireless signal connections are present.

The web speed detection assembly 27 is arranged between the short transverse cutting device 3 and the connecting cut assembly 4. It is situated near the connecting cut assembly 4. Alternatively, it is situated elsewhere in the corrugated cardboard plant.

Now also referring to FIGS. 2 to 8, the connecting cut assembly 4 shall be described in more detail in its construction.

The rotary drive 13 together with circular knife 11 is arranged on a rigid beam 29, which in turn can be changed by means of a length-adjustable lifting assembly 30 in its distance, especially its vertical distance, from the two-sided laminated corrugated cardboard web 1, especially from its surface. The lifting assembly 30 has a lifting rod 31, which is displaceable along a lifting axis 31*a* and runs straight. The lifting axis 31*a* extends vertically or perpendicular to a neighbouring surface of the two-sided laminated corrugated cardboard web 1. The beam 29 is displaceable by means of the lifting assembly 30 along the lifting axis 31*a*. It is firmly arranged on the lifting rod 31. The lifting assembly 30 is part of the vertical displacement assembly 15.

The lifting rod 31 moreover carries a counter element 32, which stands in torque-proof connection with this and hence also with the circular knife 11. The counter element 32 is configured as a partial ring body and has an outer circumferential surface 33. It extends horizontally.

The lifting rod 31 is led in a guiding assembly 34. The guiding assembly 34 comprises two guiding bodies 35, disposed one above the other, through which the lifting rod 31 is led. The guiding bodies 35 are arranged on a carrier piece 36.

Moreover, the guiding assembly 34 has an upper guiding element 37, which is likewise arranged on the carrier piece 36. The lifting rod 31 is also led through the guiding element 37. The guiding element 37 carries several brake pads 38, which are arranged around the lifting axis 31*a* and are able to rest circumferentially against the lifting rod 31 from the outside, braking it.

The lifting assembly 30 comprises a pneumatic cylinder unit 39, which sits on top of the carrier piece 36. The pneumatic cylinder unit 39 has an internal working chamber, in which a gas is located and a piston is movably disposed. The piston divides the working chamber into a first partial working chamber and a second partial working chamber. The first partial working chamber stands in fluidic communication with a first pneumatic port 40, while the second partial working chamber stands in fluidic communication with a second pneumatic port 41. The working chamber is bounded by a housing 42 of the pneumatic cylinder unit 39, on which the pneumatic ports 40, 41 are also arranged.

The lifting rod 31 is axially displaceable by extension of the piston. For this, the lifting rod 31 stands in axially firm connection with the piston, directly or indirectly.

The pneumatic ports 40, 41 stand in fluidic communication with a pneumatic pressure source for the axial displacement of the piston in the housing 42. Depending on the pressure applied to the first or second partial working chamber, the piston and hence the lifting rod 31 is axially displaceable in an extending direction or retracting direction.

On the lifting rod 31 there is located an axial end stop 43, which rests against the beam 29 on top. The axial end stop 43 is secured at least axially with respect to the lifting rod 31.

Moreover, the lifting rod 31 in one embodiment carries a sensor-ring assembly 44, which engages at its edge with a recess 45 formed in the beam 29. The sensor-ring assembly 44 is secured in the axial direction and the circumferential direction on the lifting rod 31. Adjacent to the sensor-ring assembly 44, there is secured on the carrier piece 36 a sensor 46 for interaction with the sensor-ring assembly 44. An embodiment without sensor-ring assembly 44 and sensor 46 is preferred.

The transverse displacement drive is arranged on the carrier piece 36 on the side facing away from the lifting rod 31. The transverse displacement drive is designed as a direct drive and enables a linear displacement of the knife device 10 along the guiding assembly 9.

The connecting cut assembly 4 has a pneumatic cylinder unit 47 with an axially displaceable stop element 48, which is led out from a housing 49 of the pneumatic cylinder unit 47 and firmly connected to a piston which is displaceable along a working chamber of the pneumatic cylinder unit 47. The stop element 48 is advisedly jacketed with a soft component. It extends in the conveying direction 2. The pneumatic cylinder unit 47 and the counter element 32 are part of the angle adjusting device 17.

The cross beam 8 is braced by a stand assembly 50 relatively to the floor. The stand assembly 50 comprises tubular elements 51 to carry the two-sided laminated corrugated cardboard web 1, which extend in the conveying direction 2 and are arranged at a spacing from each other transversely to this direction.

The use of the connecting cut assembly 4 shall be described more closely below. In this, we shall also refer to FIGS. 9 to 16 and 18 to 21.

The two-sided laminated corrugated cardboard web 1, which has been produced in the heating and pressing device, is conveyed continuously through the short transverse cutting device 56 and then gets to the web speed detection assembly 27, which comprises two measuring rolls 53 situated close to each other and forming a measuring gap 52. The measuring rolls 53 extend perpendicular to the conveying direction 2 and are driven to rotate by the two-sided laminated corrugated cardboard web 1 led through the measuring gap 52, from which the respective conveying speed of the two-sided laminated corrugated cardboard web 1 in the conveying direction 2 can be determined. Corresponding speed information about the two-sided laminated corrugated cardboard web 1 is supplied to the presetting unit 18 via the seventh signal line 26.

The two-sided laminated corrugated cardboard web 1 then arrives at the knife device 10. Here it lies against the tubular elements 51 and is supported by them. The two-sided laminated corrugated cardboard web 1 runs underneath the cross beam 8 and the until now inactive circular knife 11. It is conveyed without interruption.

Figure 12:
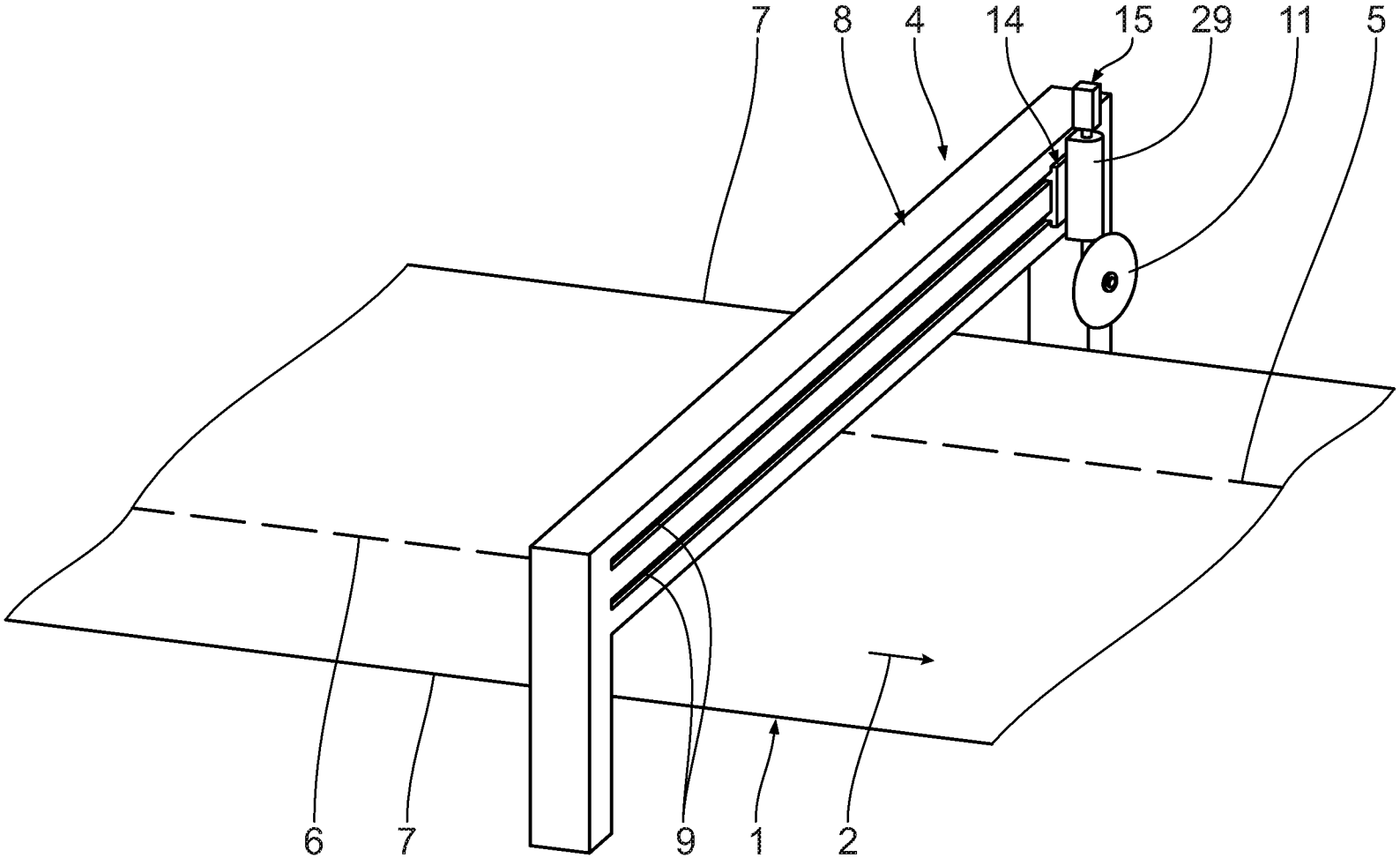

As FIG. 12 shows, the knife device 10 at first is in its inactive position. The knife device 10 is located in an end region of the guiding assembly 9. It is located close to a lengthwise edge 7 of the two-sided laminated corrugated cardboard web 1 being conveyed. The circular knife 11 is not in engagement with the two-sided laminated corrugated cardboard web 1, so that the two-sided laminated corrugated cardboard web 1 is not sliced by the connecting cut assembly 4.

Figure 13:
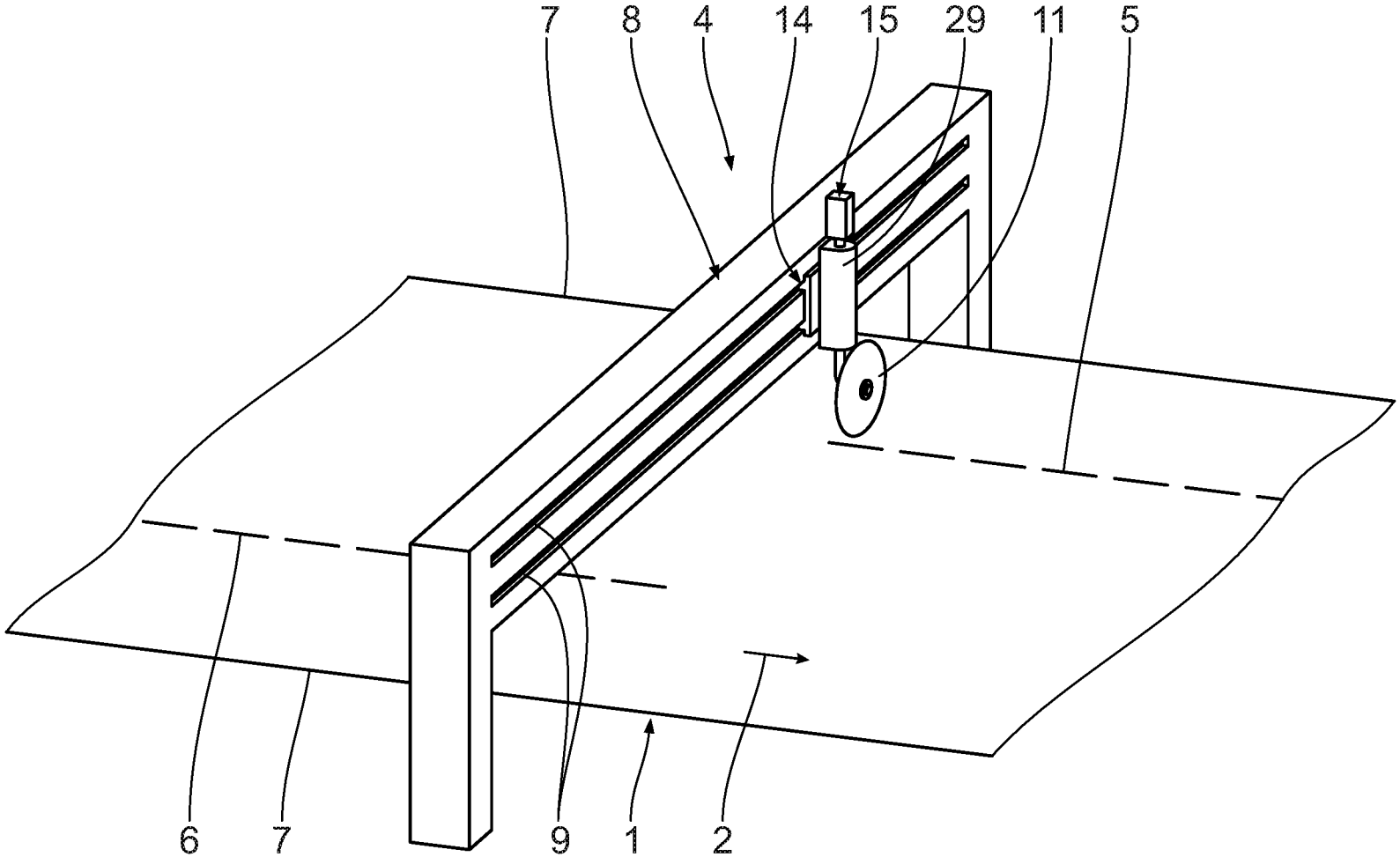

The knife device 10 is then moved for a job change along the guiding assembly 9 across the two-sided laminated corrugated cardboard web 1 being conveyed. The knife device 10 is thus moved in the transverse direction of the two-sided laminated corrugated cardboard web 1. For this, the transverse displacement drive is actuated appropriately via the sixth signal line 20. The circular knife 11 continues to be outside engagement with the two-sided laminated corrugated cardboard web 1 (FIG. 13).

Figure 14:
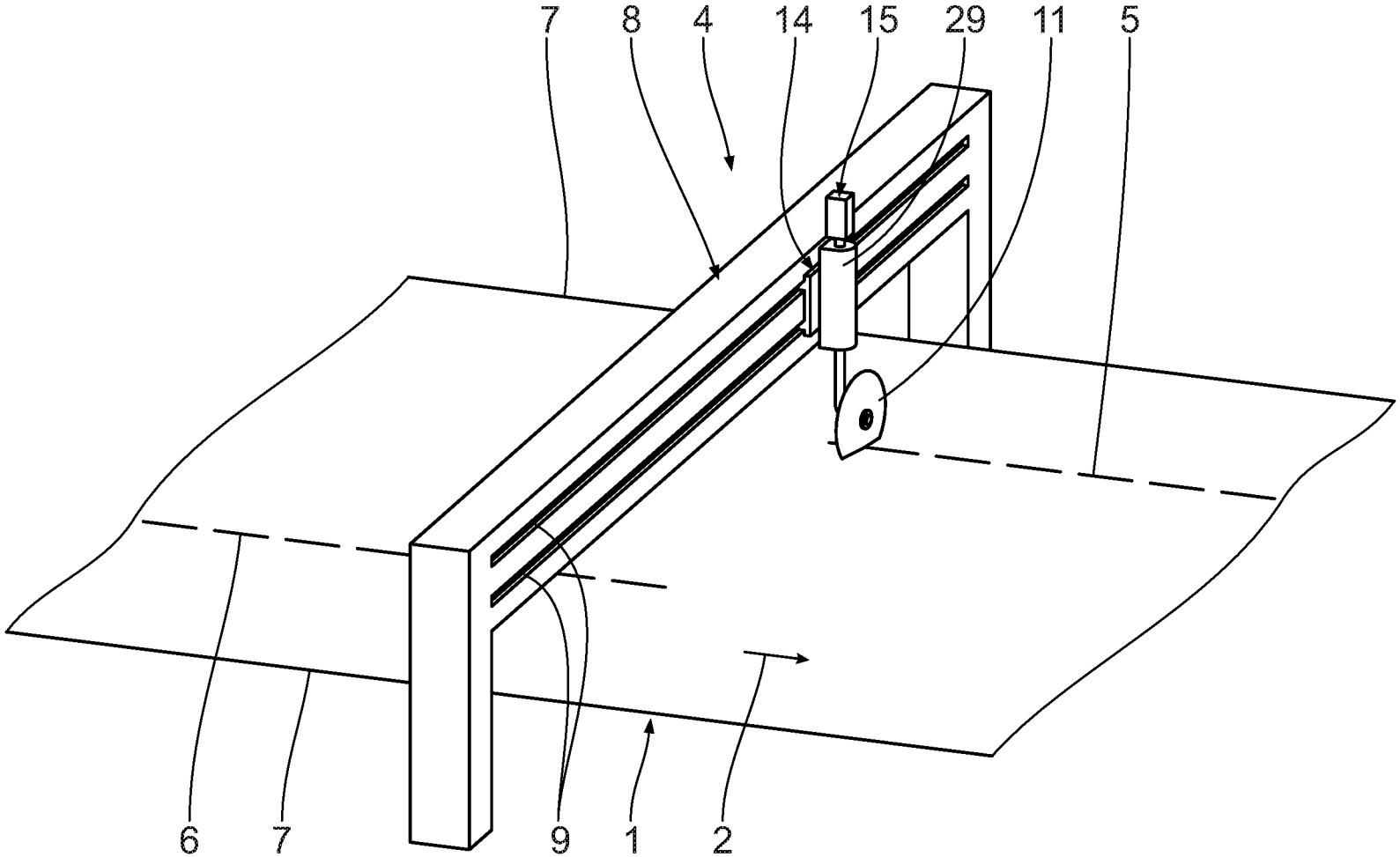

After this, the circular knife 11 is brought into cutting engagement with the corrugated cardboard web 1 by the vertical displacement assembly 15. For this, the vertical displacement assembly 15 is actuated appropriately by the third signal line 21, so that the lifting rod 31 is axially extended. The circular knife 11 is rotationally driven by the rotary drive 13. The rotary drive 13 is actuated by the first signal line 19 of the presetting unit 18 (FIG. 14).

Figure 15:
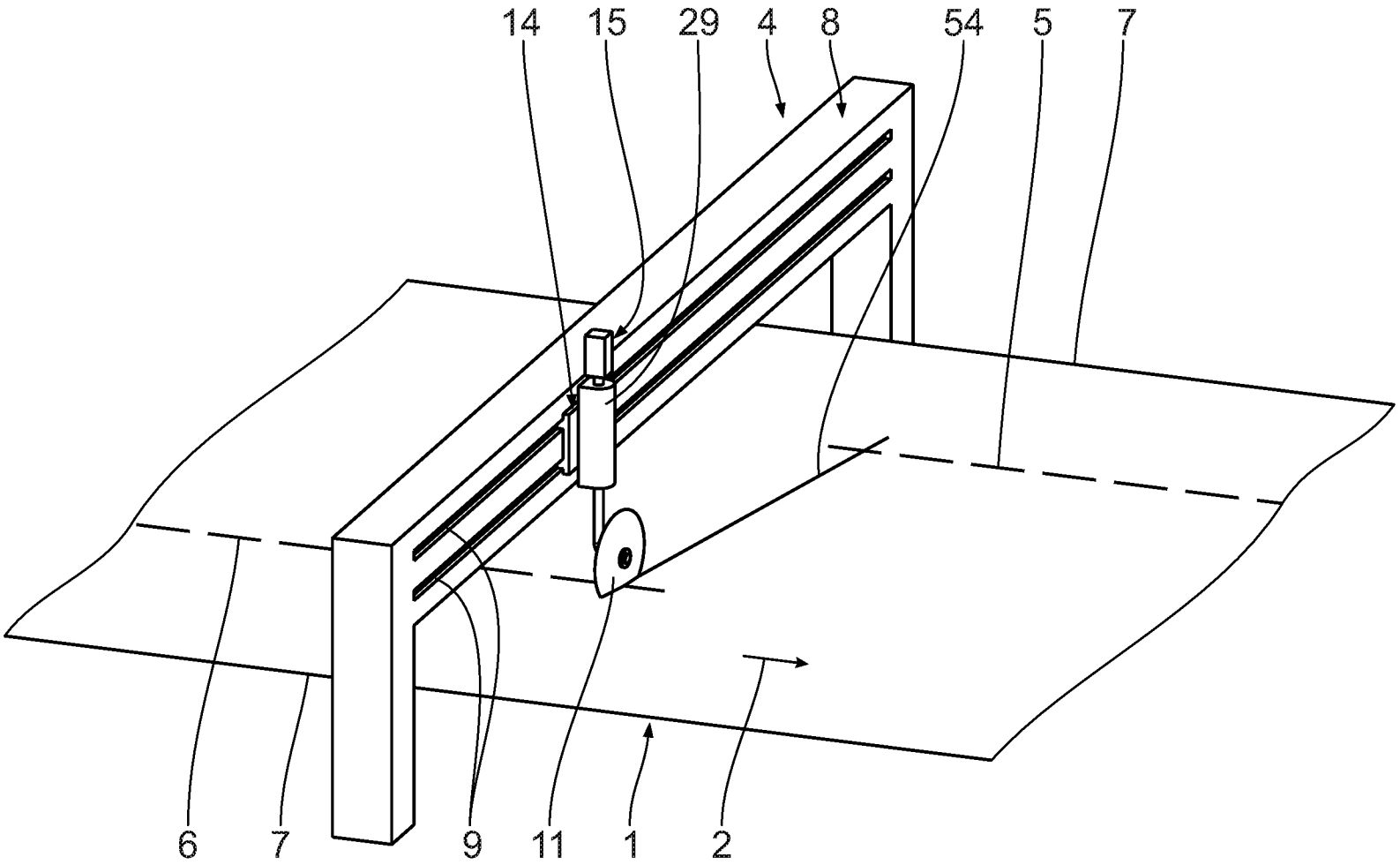
Figure 16:
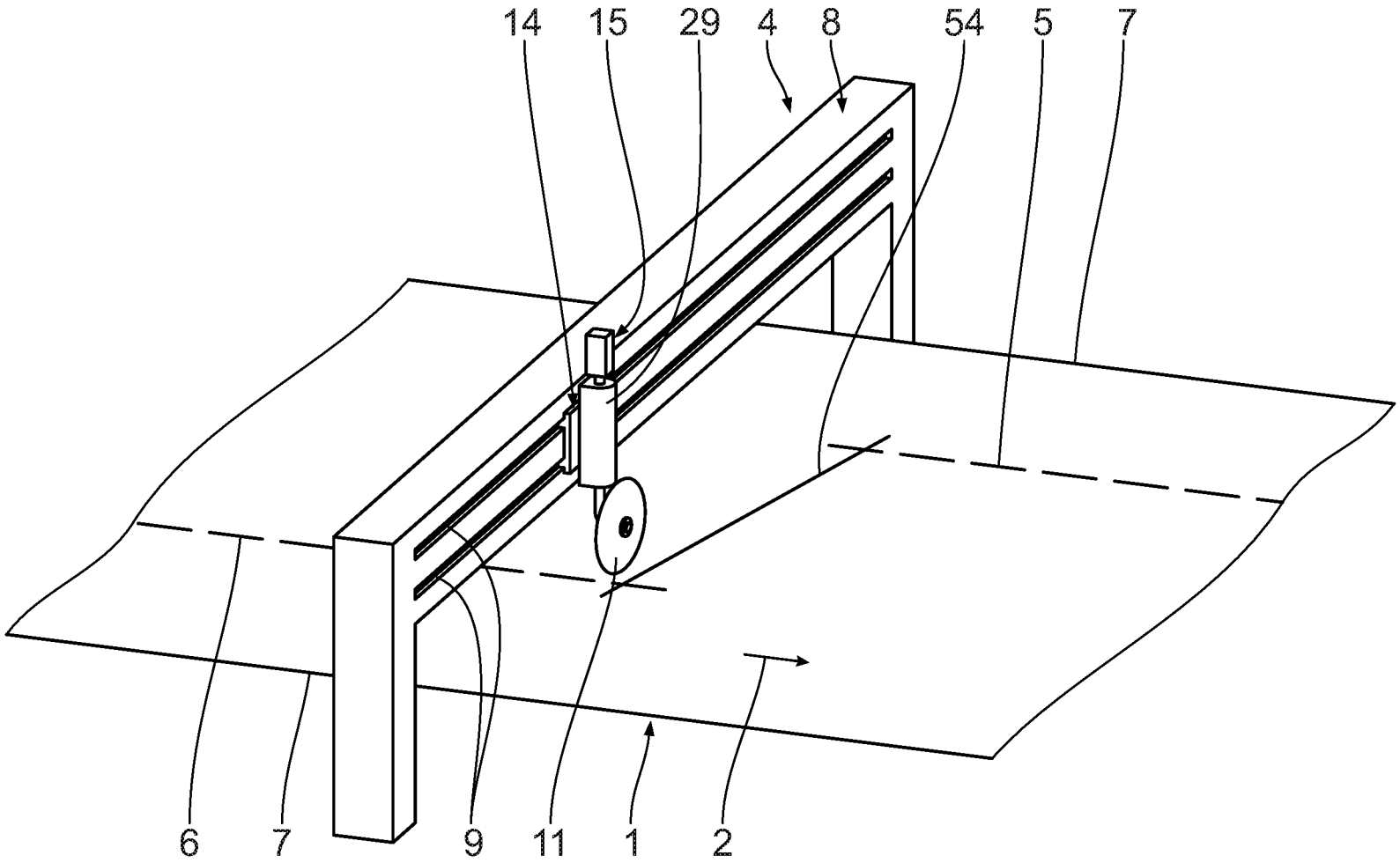

The knife device 10 is moved further by means of the transverse displacement drive along the guiding assembly 9, wherein the circular knife 11 remains in cutting engagement with the two-sided laminated corrugated cardboard web 1 being conveyed to form a straight connecting cut 54 (FIG. 15). The vertical displacement assembly 15 remains substantially non-activated during the making of the connecting cut 54 in the two-sided laminated corrugated cardboard web 1. The circular knife 11 continues to be rotationally driven.

After the end of the connecting cut 54 in the two-sided laminated corrugated cardboard web 1 (FIG. 16), the vertical displacement assembly is again activated. The lifting rod 31 is axially retracted and the circular knife 11 is lifted off from the two-sided laminated corrugated cardboard web 1, so that the connecting cut 54 in the two-sided laminated corrugated cardboard web 1 is finished. The connecting cut 54 ends up at a spacing from the lengthwise edges 7. It passes entirely through the two-sided laminated corrugated cardboard web 1 by its full thickness.

The transverse displacement drive during the making of the connecting cut 54 in the two-sided laminated corrugated cardboard web 1 substantially ensures a uniform constant cutting speed in the transverse direction of the two-sided laminated corrugated cardboard web 1. The displacement speed of the transverse displacement drive is variable.

As shown by FIG. 15, the connecting cut 54 in the two-sided laminated corrugated cardboard web 1 runs diagonally to the lengthwise edges 7. Moreover, the connecting cut 54 in the two-sided laminated corrugated cardboard web 1 runs diagonally or at an angle to the conveying direction 2 or the transverse direction of the two-sided laminated corrugated cardboard web 1.

The connecting cut 54 extends diagonally in the two-sided laminated corrugated cardboard web 1. The angle of the connecting cut 54 in the two-sided laminated corrugated cardboard web 1 corresponds to a prevailing circular knife angle of the circular knife 11 to the two-sided laminated corrugated cardboard web 1. Advisedly, the displacement speed with which the circular knife 11 moves in the one-sided laminated corrugated cardboard web 1 to produce the connecting cut 54 is adapted in order to influence the slanting position of the connecting cut 54 or obtain the desired slanting position.

Advisedly, the circular knife angle is set such that the least possible waste or scrap is produced. Preferably a presetting of the circular knife angle is done.

An adjusting of the circular knife angle by the angle adjusting device 17 is done advisedly before each job change. An independent adapting of the circular knife 11 or its angle to the conveying speed of the two-sided laminated corrugated cardboard web 1 is only possible for very small angle errors. For this, the angle adjusting device 17 is then used, being actuated appropriately by the fourth signal line 22 of the presetting unit 18. The pneumatic cylinder unit 47 extends the stop element 48 appropriately. The counter element 32 interacts with the stop element 48. The stop element 48 forms an end stop for the counter element 32, resulting in an angle adjustment or presetting of the circular knife 11 about the vertical lifting axis 31*a* relative to the two-sided laminated corrugated cardboard web 1. The brake pads 38 maintain the set angle setting of the circular knife 11.

The respective position of the circular knife 11 is detected indirectly by means of the sensor-ring assembly 44 and the sensor 46, if present. In particular, the distance of the circular knife 11 from the two-sided laminated corrugated cardboard web 1, a depth of insertion of the circular knife 11 in the two-sided laminated corrugated cardboard web 1 and/or an existing angle of the circular knife 11 relative to the two-sided laminated corrugated cardboard web 1 can be detected in this way.

Figure 9:
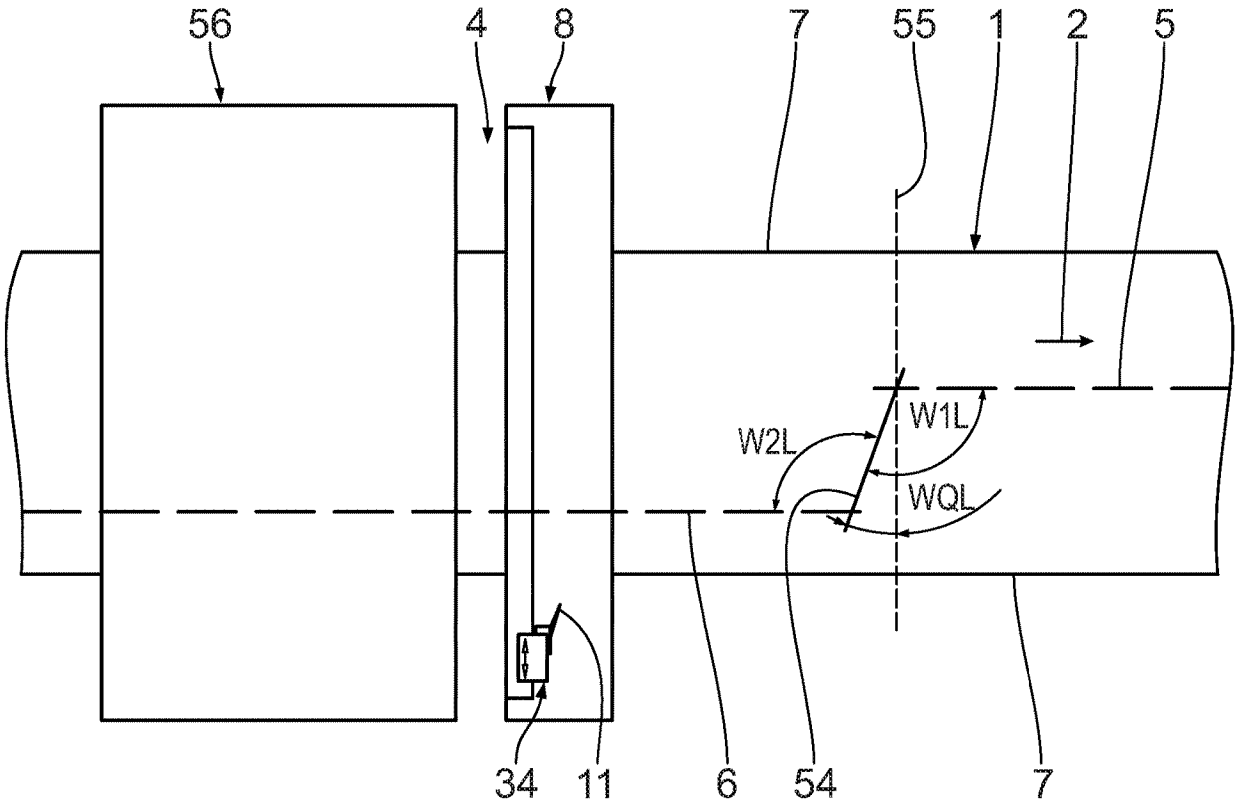
Figure 10:
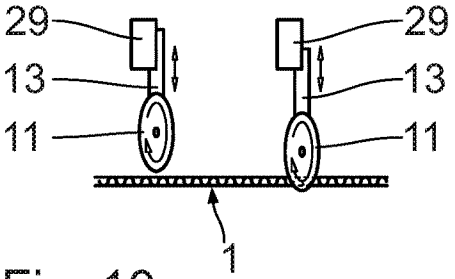
Figure 11:
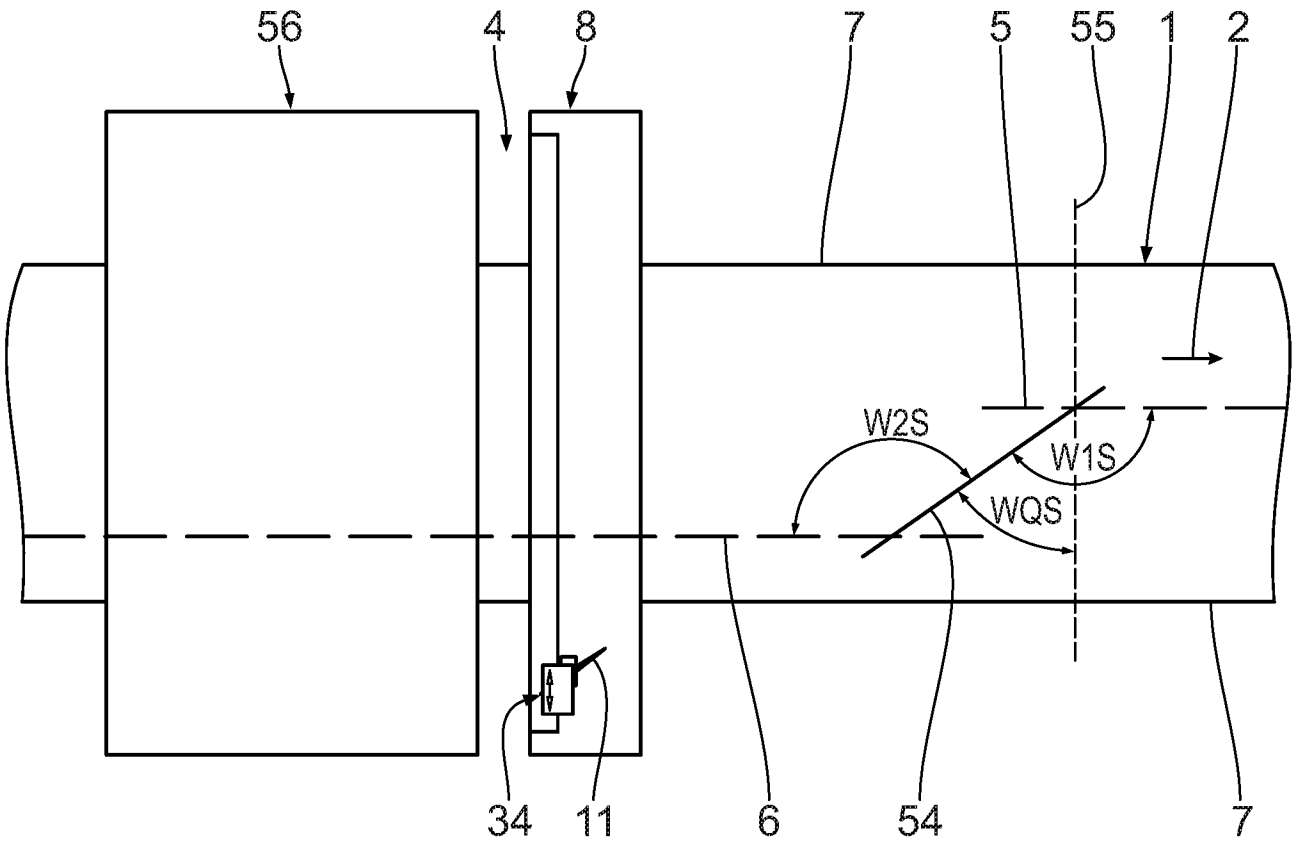

FIGS. 9 and 11 show two differently oriented connecting cuts 54 in the one-sided laminated corrugated cardboard web 1. In FIG. 9, the two-sided laminated corrugated cardboard web 1 is being transported in the conveying direction 2 with a comparatively low conveying speed. This low conveying speed, which is detected by the web speed detection assembly 27, is between 0.5 m/s and 5 m/s. The connecting cut 54 makes a first obtuse angle W1L with the first longitudinal cut 5, which is between 95° and 125°. The connecting cut 54 makes with the second longitudinal cut 6 a second obtuse angle W2L, which lies between 95° and 125° and corresponds to the first angle W1L. The two angles W1L, W2L form a Z-angle. Relative to a connection line 55 extending perpendicular to the conveying direction 2 the connecting cut 54 subtends a transverse angle WQL, which emerges from a longitudinal cut 5, 6 and is open toward the other longitudinal cut 6, 5. This transverse angle WQS lies between 10° and 30°.

In FIG. 11 the two-sided laminated corrugated cardboard web 1 is being transported with a comparatively high conveying speed in the conveying direction 2. The high conveying speed is preferably between m/s and 9 m/s. Between the connecting cut 54 and the first longitudinal cut 5 there is a first angle W1S, being between 130° and 160°. Between the connecting cut 54 and the second longitudinal cut 6 there is a second angle W2S, being between 130° and 160° and corresponding to the first angle W1S. The two angles W1S, W2S form a Z-angle. Relative to the connection line 55 extending perpendicular to the conveying direction 2 the connecting cut 54 subtends a transverse angle WQS, which emerges from a longitudinal cut 5, 6 and is open toward the other longitudinal cut 6, 5. This transverse angle WQS is between 45° and 80°.

The angles W1S, W2S of the connecting cut 54 are each greater than the angles W1L, W2L of the connecting cut 54. The connecting cut 54 present for the relatively rapidly conveyed one-sided laminated corrugated cardboard web 1 according to FIG. 11 has a greater inclination with respect to the connection line 55 running perpendicular to the conveying direction 2 than that of the rapidly conveyed one-sided laminated corrugated cardboard web 1. The greater the inclination of the connecting cut 55 with respect to the connection line 55, the greater the waste or scraps.

The two-sided laminated corrugated cardboard web 1 is also conveyed continuously through the job change cutting device 3. The job change cutting device 3 produces a first longitudinal cut 5 in the two-sided laminated corrugated cardboard web 1, thereby producing two partial two-sided laminated corrugated cardboard webs from the corrugated cardboard web 1.

Due to a job change, an altered cutting pattern or longitudinal cut is required for the two-sided laminated corrugated cardboard web 1. For this, the job change cutting device 3 produces the second longitudinal cut 6 (FIG. 1), whereby the new partial corrugated cardboard webs differ in their width from the earlier partial corrugated cardboard webs. The job change cutting device 3 may comprise for this longitudinal cutting stations arranged in succession in the conveying direction 2, being active accordingly in succession. Alternatively, a lateral displacement of one longitudinal cutting station of the job change cutting device 3 will occur.

The circular knife 11 and/or the job change cutting device 3 is/are activated so that the connecting cut 54 and the first longitudinal cut 5 meet at a trailing end section of the first longitudinal section 5. Advisedly, the lifting rod 31 has already begun to be extended upon displacement in the transverse direction of the two-sided laminated corrugated cardboard web 1 before its cutting engagement with the two-sided laminated corrugated cardboard web 1. Before reaching the entry point in the two-sided laminated corrugated cardboard web 1, the transverse displacement drive ensures a uniform increase in the cutting speed in the transverse direction to the two-sided laminated corrugated cardboard web 1.

Advisedly, the lifting rod 31 already begins to be retracted from the two-sided laminated corrugated cardboard web 1 shortly before reaching its exit point. The circular knife 11 and/or the job change cutting device 3 are activated such that the connecting cut 54 and the second longitudinal cut 6 meet at a leading end section of the second longitudinal cut 6. Then there occurs a uniform reduction in cutting speed in the transverse direction of the two-sided laminated corrugated cardboard web 1. The connecting cut 54 runs diagonally to the longitudinal cuts 5, 6.

A long region of the two-sided laminated corrugated cardboard web 1, along which the connecting cut 54 extends, forms scrap or waste.

Downstream from the job change cutting device 3 are situated a track switch 62 and a transverse cutting device 63 with transverse cutting units 64 placed one above another to produce sheets from the partial corrugated cardboard webs. The partial corrugated cardboard webs can be conveyed to the transverse cutting units 64 via the track switch 62.

Downstream from the transverse cutting device 63 are situated stacking stations 65 for stacking the sheets.

Figure 18:
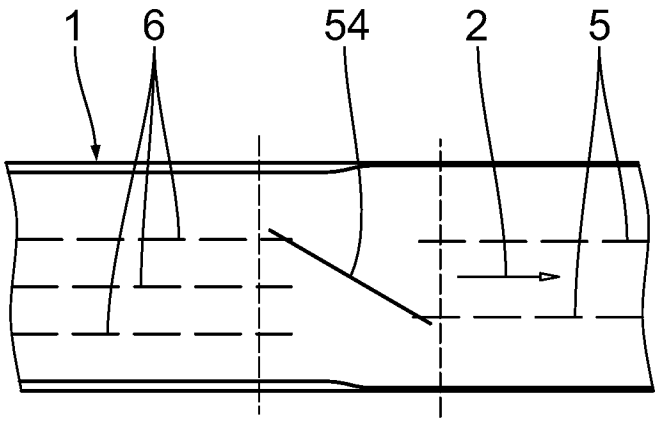

Alternative cuts shall now be described. As shown by FIG. 18, the connecting cut 54 again produces a connection between a first longitudinal cut 5 and a second longitudinal cut 6. Two first longitudinal cuts 5 are present in the two-sided laminated corrugated cardboard web 1, so that originally three partial corrugated cardboard webs were produced. In all, three second longitudinal cuts 6 are present in the two-sided laminated corrugated cardboard web 1, so that four partial corrugated cardboard webs are then produced. The number of partial corrugated cardboard webs is thus increased. The connecting cut 54 ends near the lengthwise edges 7.

The connecting cut 54 forms a connection between a first longitudinal cut 5, situated close to a first lengthwise edge 7 of the two-sided laminated corrugated cardboard web 1, and a second longitudinal cut 6, situated close to a second lengthwise edge 7 opposite the first lengthwise edge 7 of the two-sided laminated corrugated cardboard web 1. The connecting cut 54 ensures endless partial corrugated cardboard webs.

Figure 19:
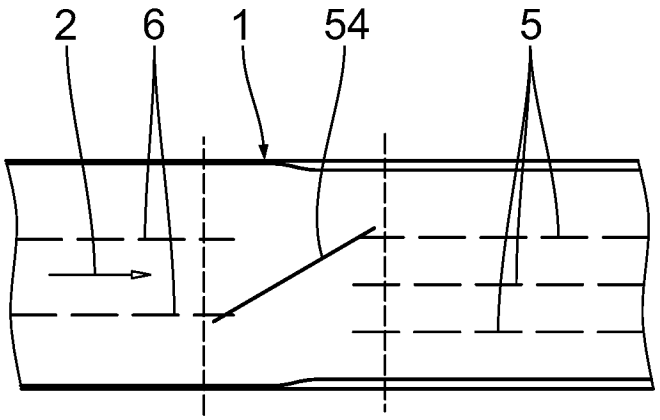

In FIG. 19 there are a total of three first longitudinal cuts 5 present, so that four partial corrugated cardboard webs have been formed. Moreover, two second longitudinal cuts 6 are present, so that only three partial corrugated cardboard webs are produced afterwards. The number of partial corrugated cardboard webs is thus reduced. The connecting cut 54 ends near the lengthwise edges 7.

The connecting cut 54 again extends from a first longitudinal cut 5 near the first lengthwise edge 7 to a second longitudinal cut 6, situated near the second lengthwise edge 7 opposite the first lengthwise edge 7. Once again, endless partial corrugated cardboard webs are present.

Figure 20:
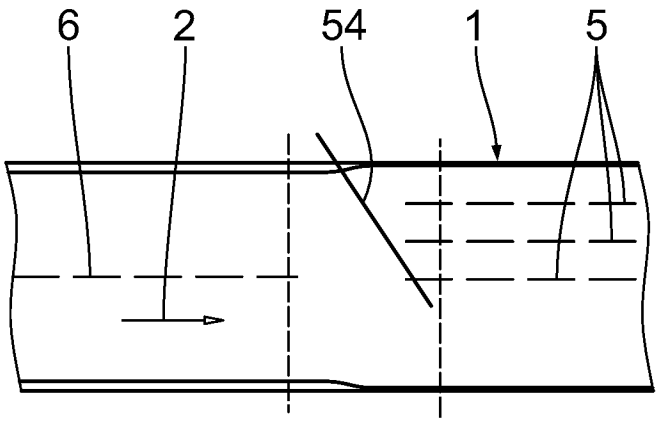

In FIG. 20, three first longitudinal cuts 5 are present, so that four partial corrugated cardboard webs have been produced. A switch then occurs to a second longitudinal cut 6, so that then only two partial corrugated cardboard webs are still produced. The connecting cut 54 runs from a first lengthwise edge 7 of the two-sided laminated corrugated cardboard web 1 to a first longitudinal cut 5 which has the greatest distance from the first lengthwise edge 7. It runs at a spacing from the second longitudinal cut 6.

Figure 21:
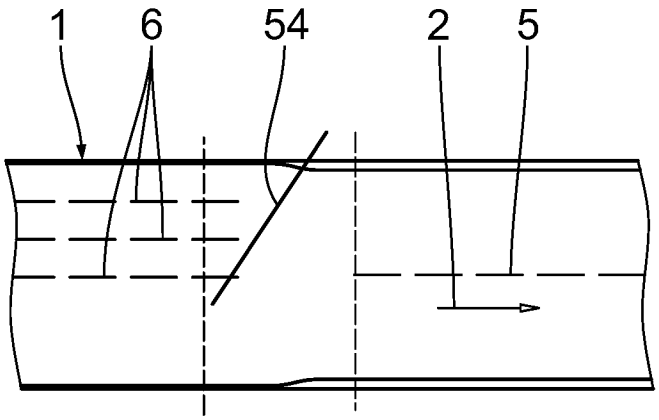

In FIG. 21, a first longitudinal cut 5 is present, so that two partial corrugated cardboard webs have been produced. A switch then occurs to three second longitudinal cuts 6, so that four partial corrugated cardboard webs are then produced. The connecting cut 54 runs from a first lengthwise edge 7 of the two-sided laminated corrugated cardboard web 1 to a second longitudinal cut 6 having the greatest distance from the first lengthwise edge 7. It runs at a spacing from the first longitudinal cut 5.

Figure 22:
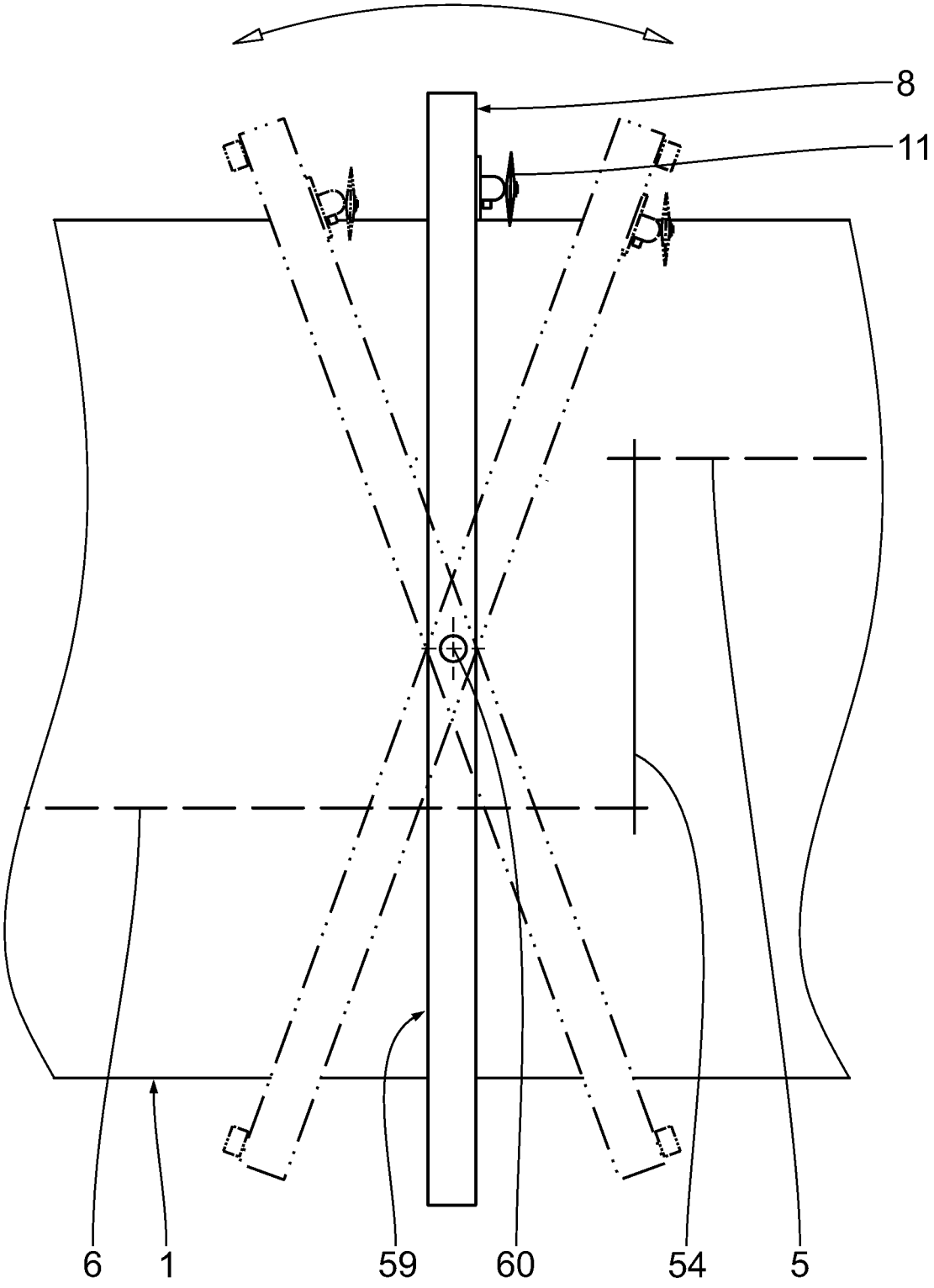
Figure 23:
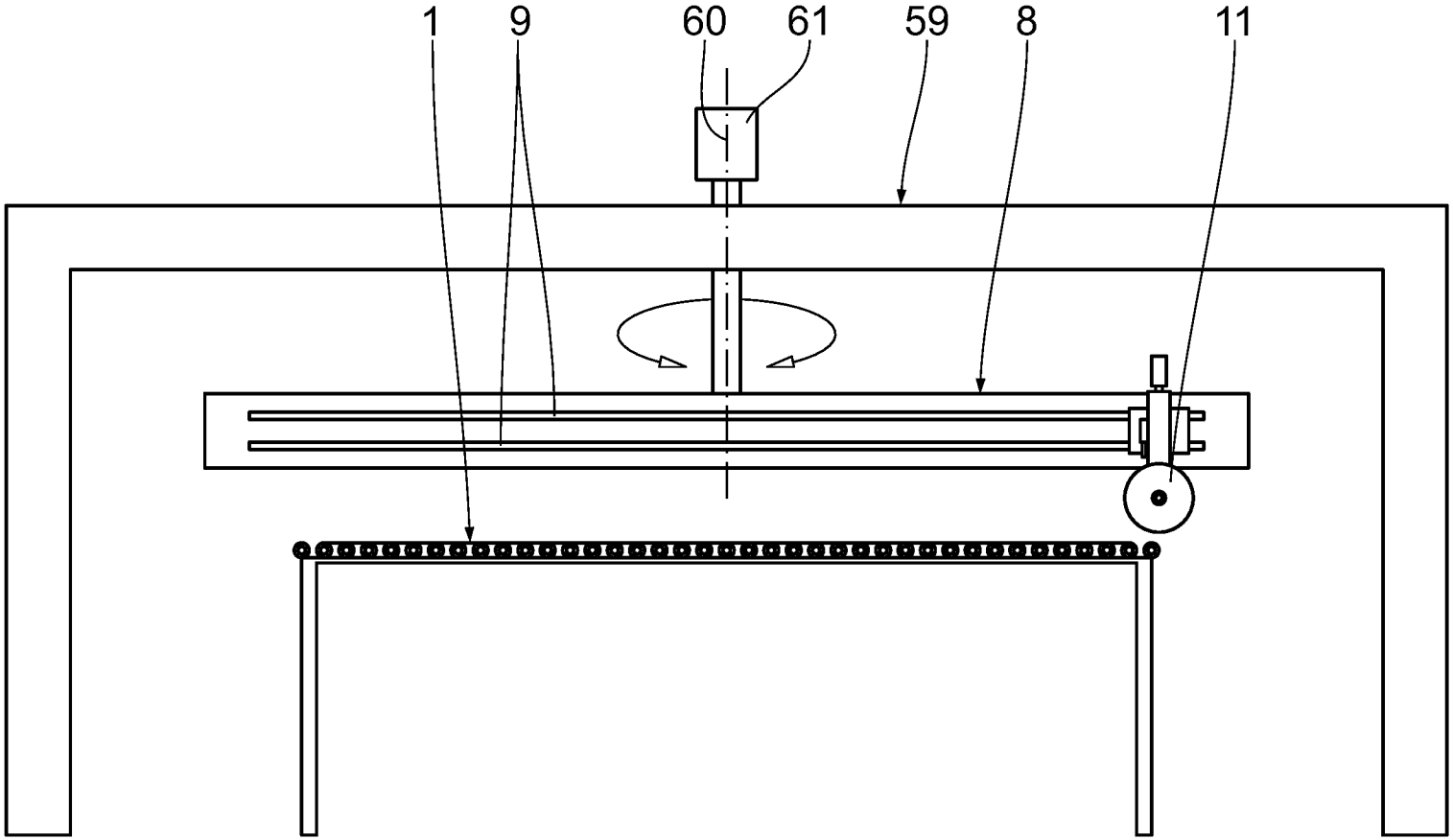

According to an alternative embodiment represented in FIG. 22, 23, the cross beam 8 is adjustable so that it makes a diagonal position angle with the two-sided laminated corrugated cardboard web 1 in the conveying direction 2 amounting to as much as 45°. The cross beam 8 is thus able to extend diagonally across the two-sided laminated corrugated cardboard web 1. It runs horizontally.

A connecting cut 54 may thus be produced which is hardly slanted with respect to the connection line 55 or which extends vertically to the conveying direction 2 of the two-sided laminated corrugated cardboard web 1. The scrap or waste is thus extremely slight or equal to zero.

For this, the cross beam 8 is arranged on a machine frame 59 which is braced against the floor or base. The cross beam 8 is swivelable relative to the machine frame 59 about a vertical pivot axis 60. A servomotor 61 is used for the swivelling of the cross beam 8, standing in signal communication with the presetting unit 18. The pivot axis 60 advisedly passes through a central elongated region of the two-sided laminated corrugated cardboard web 1.

What is claimed is:

1. A connecting cut assembly for producing connecting cuts in a material web being conveyed in a conveying direction, the connecting cut assembly comprising:

at least one knife device comprising a cutting knife for cutting engagement with the material web to produce a connecting cut, the cutting knife being adjustable in its angle to the material web, wherein a first cutting knife transverse angle to a connection line running perpendicular to the conveying direction of the material web at relatively high conveying speed of the material web is larger than a corresponding second cutting knife transverse angle to the connection line which is present at a slower conveying speed of the material web.

2. The connecting cut assembly according to claim 1, wherein the cutting knife is adjustable in its angle to one of a conveying direction and a transverse direction of the material web.

3. The connecting cut assembly according to claim 1, further comprising an actuatable cutting knife angle adjusting device for setting a respective cutting knife angle of the cutting knife to the material web.

4. The connecting cut assembly according to claim 3, wherein the cutting knife angle adjusting device of the at least one knife device comprises an adjustable stop element assembly and a counter element, which is in an angular connection with the cutting knife of the at least one knife device and interacts with the stop element assembly to set the respective cutting knife angle.

5. The connecting cut assembly according to claim 3, further comprising at least one presetting unit for actuating the respective cutting knife angle adjusting device.

6. The connecting cut assembly according to claim 1, wherein a cutting knife angle setting of the at least one knife device occurs in dependence on a conveying speed of the material web.

7. The connecting cut assembly according to claim 1, wherein at a first conveying speed of the material web a first cutting knife angle to the conveying direction is present and at a second conveying speed of the material web, different from the first conveying speed, a second cutting knife angle to the conveying direction is present, differing from the first cutting knife angle.

8. The connecting cut assembly according to claim 1, wherein the at least one knife device comprises a brake assembly for at least temporary holding the cutting knife angle.

9. The connecting cut assembly according to claim 1, wherein the cutting knife angle is adjustable in an angle range between 90° and 180°.

10. The connecting cut assembly according to claim 9, wherein the cutting knife angle is adjustable continuously.

11. The connecting cut assembly according to claim 1, wherein the at least one knife device comprises a positioning detection assembly for detecting a respective cutting knife angle.

12. The connecting cut assembly according to claim 1, wherein the at least one presetting unit comprises at least one correction unit for correcting a deviation between the detected cutting knife angles and a target cutting knife angle.

13. The connecting cut assembly according to claim 1, wherein the at least one knife device comprises a rotary drive for rotational driving of the cutting knife.

14. The connecting cut assembly according to claim 1, further comprising a cutting knife displacement assembly for displacing the cutting knife between an active cutting position for cutting engagement with the material web and an inactive position.

15. The connecting cut assembly according to claim 14, wherein an adjustment of the cutting knife angle occurs in the inactive position of the cutting knife.

16. The connecting cut assembly according to claim 1, further comprising a cutting knife transverse displacement assembly for displacing the cutting knife in a transverse direction of the material web.

17. The connecting cut assembly according to claim 16, wherein the cutting knife transverse displacement assembly comprises at least one cross beam extending diagonally with respect to the conveying direction of the material web.

18. The connecting cut assembly according to claim 16, wherein the cutting knife transverse displacement assembly comprises at least one cross beam which is swivelable about a vertical pivot axis.

19. The connecting cut assembly according to claim 1, wherein a displacement speed of the cutting knife in the transverse direction of the material web is dependent on a conveying speed of the material web.

20. A connecting cut assembly for producing connecting cuts in a material web being conveyed in a conveying direction, the connecting cut assembly comprising:

at least one knife device comprising a cutting knife for cutting engagement with the material web to produce a connecting cut, the cutting knife being adjustable in its angle to the material web;

an actuatable cutting knife angle adjusting device for setting a respective cutting knife angle of the cutting knife to the material web; and at least one presetting unit for actuating the respective cutting knife angle adjusting device, wherein the at least one presetting unit comprises at least one correction unit for correcting a deviation between the detected cutting knife angles and a target cutting knife angle.

21. A connecting cut assembly for producing connecting cuts in a material web being conveyed in a conveying direction, the connecting cut assembly comprising:

at least one knife device comprising a cutting knife for cutting engagement with the material web to produce a connecting cut, the cutting knife being adjustable in its angle to the material web;

a cutting knife displacement assembly for displacing the cutting knife between an active cutting position for cutting engagement with the material web and an inactive position, wherein an adjustment of the cutting knife angle occurs in the inactive position of the cutting knife.

* * * * *